US008371919B2

(12) United States Patent
Hornik et al.

(10) Patent No.: US 8,371,919 B2
(45) Date of Patent: Feb. 12, 2013

(54) WAGERING GAME WITH COMMUNITY GAME HAVING A PERSISTENT-STATE FEATURE

(75) Inventors: Jeremy M. Hornik, Chicago, IL (US); Joel R. Jaffe, Glenview, IL (US); Larry J. Pacey, Chicago, IL (US); Jamie Vann, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 586 days.

(21) Appl. No.: 12/446,141

(22) PCT Filed: Oct. 15, 2007

(86) PCT No.: PCT/US2007/022142

§ 371 (c)(1),
(2), (4) Date: Apr. 17, 2009

(87) PCT Pub. No.: WO2008/048634

PCT Pub. Date: Apr. 24, 2008

(65) Prior Publication Data

US 2010/0317424 A1 Dec. 16, 2010

Related U.S. Application Data

(60) Provisional application No. 60/852,886, filed on Oct. 18, 2006.

(51) Int. Cl.
*A63F 9/24* (2006.01)

(52) U.S. Cl. ..... 463/16; 463/20; 463/23

(58) Field of Classification Search ..... 463/16–21, 463/24

See application file for complete search history.

(56) References Cited

U.S. PATENT DOCUMENTS

| | | | | |
|---|---|---|---|---|
| 4,342,454 | A | 8/1982 | Baer et al. | 273/85 |
| 4,575,622 | A | 3/1986 | Pellegrini | 235/382 |
| 4,752,068 | A | 6/1988 | Endo | |
| 4,764,666 | A | 8/1988 | Bergeron | 235/380 |
| 4,858,930 | A | 8/1989 | Sato | 273/85 |
| 4,882,473 | A | 11/1989 | Bergeron et al. | 235/380 |
| 4,948,138 | A | 8/1990 | Pease et al. | 273/138 |
| 5,014,982 | A | 5/1991 | Okada et al. | 273/435 |
| 5,018,736 | A | 5/1991 | Pearson et al. | 273/439 |
| 5,179,517 | A | 1/1993 | Sarbin et al. | 364/410 |
| 5,265,874 | A | 11/1993 | Dickinson et al. | 273/138 |
| 5,292,127 | A | 3/1994 | Kelly et al. | 273/138 R |

(Continued)

FOREIGN PATENT DOCUMENTS

| | | |
|---|---|---|
| DE | 4200254 | 8/1993 |
| DE | 4236968 | 5/1994 |

(Continued)

OTHER PUBLICATIONS

U.S. Appl. No. 60/200,329, dated Apr. 28, 2000, 8 pages.

(Continued)

*Primary Examiner* — Julio J Maldonado
*Assistant Examiner* — Daniel Shook
(74) *Attorney, Agent, or Firm* — Nixon Peabody LLP

(57) ABSTRACT

A gaming system for playing a wagering game includes a plurality of gaming machines configured to receive a wagering input and to access a group game including a persistent-state gaming environment. A controller is configured to maintain the persistent-state gaming environment and to control game play within the persistent-state gaming environment. The persistent-state gaming environment is configured to permit ingress and egress of players into and out of the persistent-state gaming environment.

25 Claims, 10 Drawing Sheets

U.S. PATENT DOCUMENTS

| | | | | |
|---|---|---|---|---|
| 5,321,241 | A | 6/1994 | Craine | 235/380 |
| 5,370,306 | A | 12/1994 | Schulze et al. | 273/138 |
| 5,370,399 | A | 12/1994 | Liverance | 273/434 |
| 5,393,057 | A | 2/1995 | Marnell, II | 273/85 |
| 5,429,361 | A | 7/1995 | Raven et al. | 273/138 |
| 5,470,079 | A | 11/1995 | LeStrange et al. | 273/138 |
| 5,533,727 | A | 7/1996 | DeMar | 463/23 |
| 5,547,202 | A | 8/1996 | Tsumura | 463/29 |
| 5,551,692 | A | 9/1996 | Pettit et al. | 273/143 R |
| 5,575,474 | A | 11/1996 | Rossides | |
| 5,580,053 | A | 12/1996 | Crouch | 463/20 |
| 5,580,309 | A | 12/1996 | Piechowiak et al. | 463/16 |
| 5,586,766 | A | 12/1996 | Forte et al. | 273/309 |
| 5,586,936 | A | 12/1996 | Bennett et al. | 463/25 |
| 5,609,525 | A | 3/1997 | Ohno et al. | |
| 5,655,961 | A | 8/1997 | Acres et al. | 463/27 |
| 5,674,128 | A | 10/1997 | Holch et al. | 463/42 |
| 5,702,304 | A | 12/1997 | Acres et al. | 463/29 |
| 5,741,183 | A | 4/1998 | Acres et al. | 463/42 |
| 5,743,523 | A | 4/1998 | Kelly et al. | 273/138.1 |
| 5,743,800 | A | 4/1998 | Huard et al. | 463/26 |
| 5,752,882 | A | 5/1998 | Acres et al. | 463/42 |
| 5,761,647 | A | 6/1998 | Boushy | 705/10 |
| 5,770,533 | A | 6/1998 | Franchi | 463/42 |
| 5,816,918 | A | 10/1998 | Kelly et al. | 463/16 |
| 5,820,459 | A | 10/1998 | Acres et al. | 463/25 |
| 5,833,537 | A | 11/1998 | Barrie | |
| 5,833,540 | A | 11/1998 | Miodunski et al. | 463/42 |
| 5,836,817 | A | 11/1998 | Acres et al. | 463/26 |
| 5,882,258 | A | 3/1999 | Kelly et al. | 463/11 |
| 5,902,983 | A | 5/1999 | Crevelt et al. | 235/380 |
| 5,919,091 | A | 7/1999 | Bell et al. | 463/25 |
| 5,931,467 | A | 8/1999 | Kamille | 273/139 |
| 5,957,775 | A | 9/1999 | Cherry | |
| 5,983,196 | A | 11/1999 | Wendkos | 705/14 |
| 5,997,401 | A | 12/1999 | Crawford | 463/20 |
| 6,004,211 | A | 12/1999 | Brenner et al. | |
| 6,007,426 | A | 12/1999 | Kelly et al. | 463/16 |
| 6,009,412 | A | 12/1999 | Storey | 705/14 |
| 6,012,045 | A | 1/2000 | Barzilai et al. | |
| 6,012,983 | A | 1/2000 | Walker et al. | |
| 6,015,344 | A | 1/2000 | Kelly et al. | |
| 6,048,269 | A | 4/2000 | Burns et al. | 463/25 |
| 6,061,660 | A | 5/2000 | Eggleston et al. | 705/14 |
| 6,068,552 | A | 5/2000 | Walker et al. | 463/21 |
| 6,068,553 | A | 5/2000 | Parker | 463/27 |
| 6,077,163 | A | 6/2000 | Walker et al. | |
| 6,110,041 | A | 8/2000 | Walker et al. | 463/20 |
| 6,113,098 | A | 9/2000 | Adams | |
| 6,113,493 | A | 9/2000 | Walker et al. | 463/25 |
| 6,162,122 | A | 12/2000 | Acres et al. | 463/29 |
| 6,165,071 | A | 12/2000 | Weiss | |
| 6,178,408 | B1 | 1/2001 | Copple et al. | 705/14 |
| 6,179,710 | B1 | 1/2001 | Sawyer et al. | 463/16 |
| 6,193,608 | B1 | 2/2001 | Walker et al. | 463/25 |
| 6,203,430 | B1 | 3/2001 | Walker et al. | 463/20 |
| 6,227,972 | B1 | 5/2001 | Walker et al. | 463/25 |
| 6,231,445 | B1 | 5/2001 | Acres | 463/42 |
| 6,234,896 | B1 | 5/2001 | Walker et al. | |
| 6,244,958 | B1 | 6/2001 | Acres | 463/26 |
| 6,251,014 | B1 | 6/2001 | Stockdale et al. | 463/16 |
| 6,254,481 | B1 | 7/2001 | Jaffe | |
| 6,254,483 | B1 | 7/2001 | Acres | 463/26 |
| 6,273,820 | B1 | 8/2001 | Haste, III | |
| 6,280,326 | B1 | 8/2001 | Saunders | 463/25 |
| 6,293,866 | B1 | 9/2001 | Walker et al. | 463/20 |
| 6,302,790 | B1 | 10/2001 | Brossard | |
| 6,302,793 | B1 | 10/2001 | Fertitta, III et al. | 463/25 |
| 6,311,976 | B1 | 11/2001 | Yoseloff et al. | |
| 6,312,334 | B1 | 11/2001 | Yoseloff | 705/14 |
| 6,319,127 | B1 | 11/2001 | Walker et al. | |
| 6,334,613 | B1 | 1/2002 | Yoseloff | 463/21 |
| 6,340,331 | B1 | 1/2002 | Saunders et al. | 463/20 |
| 6,364,765 | B1 | 4/2002 | Walker et al. | |
| 6,364,766 | B1 | 4/2002 | Anderson et al. | 463/16 |
| 6,365,765 | B1 | 4/2002 | Baldwin et al. | |
| 6,371,852 | B1 | 4/2002 | Acres | 463/25 |
| 6,386,975 | B1 * | 5/2002 | Peterson | 463/16 |
| 6,394,900 | B1 | 5/2002 | McGlone et al. | 463/29 |
| 6,394,907 | B1 | 5/2002 | Rowe | 463/24 |
| 6,398,650 | B1 | 6/2002 | Horigami et al. | 705/14 |
| 6,431,983 | B2 | 8/2002 | Acres | |
| 6,506,117 | B2 | 1/2003 | DeMar et al. | |
| 6,506,118 | B1 | 1/2003 | Baerlocher et al. | |
| 6,533,273 | B2 | 3/2003 | Cole et al. | 273/138 |
| 6,540,609 | B1 | 4/2003 | Paige | 463/25 |
| 6,592,456 | B2 | 7/2003 | Walker et al. | 463/20 |
| 6,592,457 | B1 | 7/2003 | Frohm et al. | 463/25 |
| 6,605,001 | B1 | 8/2003 | Tarantino | 705/14 |
| 6,609,975 | B1 | 8/2003 | Sawyer et al. | 463/26 |
| 6,612,575 | B1 | 9/2003 | Cole et al. | 273/138 |
| 6,663,489 | B2 | 12/2003 | Baerlocher | |
| 6,682,421 | B1 | 1/2004 | Rowe et al. | 463/25 |
| 6,722,981 | B2 | 4/2004 | Kaminkow et al. | |
| 6,722,985 | B2 | 4/2004 | Criss-Puszkiewicz et al. | |
| 6,745,236 | B1 | 6/2004 | Hawkins et al. | |
| 6,752,312 | B1 | 6/2004 | Chamberlain et al. | 235/375 |
| 6,758,757 | B2 | 7/2004 | Luciano, Jr. et al. | |
| 6,776,713 | B2 | 8/2004 | Gauselmann | |
| 6,780,111 | B2 * | 8/2004 | Cannon et al. | 463/25 |
| 6,800,027 | B2 | 10/2004 | Giobbi et al. | |
| 6,811,486 | B1 | 11/2004 | Luciano, Jr. | |
| 6,840,860 | B1 | 1/2005 | Okuniewicz | 463/35 |
| 6,923,721 | B2 | 8/2005 | Luciano et al. | |
| 7,182,690 | B2 | 2/2007 | Giobbi et al. | |
| 7,682,244 | B1 | 3/2010 | Luciano, Jr. et al. | 463/25 |
| 2001/0024971 | A1 | 9/2001 | Brossard | |
| 2001/0046893 | A1 | 11/2001 | Giobbi et al. | 463/24 |
| 2001/0048193 | A1 | 12/2001 | Yoseloff et al. | 273/138.1 |
| 2002/0028708 | A1 | 3/2002 | Busch et al. | |
| 2002/0039919 | A1 | 4/2002 | Joshi et al. | |
| 2002/0074726 | A1 | 6/2002 | Yoseloff et al. | 273/274 |
| 2002/0077170 | A1 | 6/2002 | Johnson et al. | 463/16 |
| 2002/0077173 | A1 | 6/2002 | Luciano, Jr. et al. | |
| 2002/0077174 | A1 | 6/2002 | Luciano et al. | |
| 2002/0093136 | A1 | 7/2002 | Moody | |
| 2002/0094871 | A1 | 7/2002 | Luciano, Jr. et al. | |
| 2002/0107065 | A1 | 8/2002 | Rowe | |
| 2002/0151349 | A1 | 10/2002 | Joshi | |
| 2002/0196342 | A1 | 12/2002 | Walker et al. | |
| 2003/0013515 | A1 | 1/2003 | Rowe et al. | |
| 2003/0013531 | A1 | 1/2003 | Rowe et al. | |
| 2003/0036422 | A1 | 2/2003 | Baerlocher et al. | |
| 2003/0036427 | A1 | 2/2003 | Brandstetter et al. | |
| 2003/0064794 | A1 | 4/2003 | Mead et al. | |
| 2003/0078101 | A1 | 4/2003 | Schneider et al. | |
| 2003/0100362 | A1 | 5/2003 | Horniak et al. | |
| 2003/0106769 | A1 | 6/2003 | Weiss | |
| 2003/0114219 | A1 | 6/2003 | McClintic | |
| 2003/0119579 | A1 | 6/2003 | Walker et al. | |
| 2003/0157979 | A1 | 8/2003 | Cannon et al. | |
| 2003/0195024 | A1 | 10/2003 | Slattery | |
| 2003/0211881 | A1 | 11/2003 | Walker et al. | |
| 2004/0053680 | A1 | 3/2004 | Schultz | |
| 2004/0142742 | A1 | 7/2004 | Schneider et al. | |
| 2004/0209662 | A1 | 10/2004 | Wadleigh | 463/16 |
| 2005/0003886 | A1 | 1/2005 | Englman et al. | |
| 2005/0090304 | A1 | 4/2005 | Crawford, III et al. | |
| 2005/0159207 | A1 | 7/2005 | Thomas | |
| 2005/0193209 | A1 | 9/2005 | Saunders et al. | |
| 2006/0068893 | A1 | 3/2006 | Jaffe et al. | |
| 2006/0074504 | A1 * | 4/2006 | Maul | 700/91 |
| 2006/0079316 | A1 | 4/2006 | Flemming et al. | |
| 2006/0079317 | A1 | 4/2006 | Flemming et al. | |
| 2006/0084495 | A1 | 4/2006 | Jaffe et al. | |
| 2006/0084496 | A1 | 4/2006 | Jaffe et al. | 463/20 |
| 2006/0089194 | A1 | 4/2006 | Joshi et al. | |
| 2006/0111170 | A1 * | 5/2006 | Hornik et al. | 463/16 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |
| 2007/0298856 | A1 | 12/2007 | Gilmore et al. | 463/16 |
| 2008/0113770 | A1 | 5/2008 | Gelber et al. | 463/25 |

FOREIGN PATENT DOCUMENTS

| | | | |
|---|---|---|---|
| EP | 0 360 613 | | 3/1990 |
| EP | 0 431 723 | | 6/1991 |
| ES | 2028694 | | 7/1992 |
| GB | 2 241 098 | | 8/1991 |
| GB | 2 332 151 | | 6/1999 |
| JP | 60-106680 | | 7/1985 |
| JP | 2265584 | | 10/1990 |
| JP | 04-009177 | | 1/1992 |
| JP | 04-079977 | | 3/1992 |
| JP | 05-277233 | | 10/1993 |
| JP | 07-024128 | | 1/1995 |
| JP | 07-155453 | | 6/1995 |
| JP | 09-276500 | | 10/1997 |
| JP | 10-066777 | | 3/1998 |
| JP | 10-146423 | | 6/1998 |
| JP | 11-309246 | | 11/1999 |
| WO | WO 95/22811 | | 8/1995 |
| WO | WO 97/12338 | | 4/1997 |
| WO | WO 99/29381 | | 6/1999 |
| WO | WO 02/21467 | | 3/2002 |
| WO | WO 2005/082480 | A1 | 9/2005 |
| WO | WO 2006/002241 | A2 | 1/2006 |
| WO | WO 2006/004831 | A2 | 1/2006 |
| WO | WO 2006/004832 | A2 | 1/2006 |
| WO | WO 2006/005073 | A2 | 1/2006 |
| WO | WO 2006/017036 | A1 | 2/2006 |
| WO | WO 2006/017067 | A1 | 2/2006 |
| WO | WO 2006/017068 | A1 | 2/2006 |
| WO | WO 2006/020811 | A2 | 2/2006 |
| WO | WO 2006/026250 | A2 | 3/2006 |
| WO | WO 2006/044252 | A2 | 4/2006 |
| WO | WO 2007/103054 | | 9/2007 |
| WO | WO 2008/048634 | | 4/2008 |

OTHER PUBLICATIONS

International Search Report, PCT/US07/22142, dated Apr. 21, 2008, 2 pages.

* cited by examiner

WAGERING GAME WITH COMMUNITY GAME HAVING A PERSISTENT-STATE FEATURE

CROSS REFERENCE TO RELATED APPLICATIONS

This application is a U.S. national stage of International Application No. PCT/US2007/022142, filed Oct. 15, 2007, which is related to and claims priority from U.S. Provisional Application No. 60/852,866, filed Oct. 18, 2006, which is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games, and more particularly, to wagering games with a community game having a persistent-state feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Community games have been involve engaging multiple players to enter a shared, or community, wagering game wherein multiple gaming machines are linked together to play a shared basic or bonus game. One such game is disclosed in Application Ser. No. PCT/US2006/018045 filed on May 9, 2006, titled "Wagering Game System with Shared Outcome Determined by a Gaming Machine" and assigned to WMS Gaming Inc., which is incorporated by reference herein in its entirety. As the interest and demand for these types of community games increases, there is also a continuing need to develop new features for these games that enhance the gaming experience.

SUMMARY OF THE INVENTION

According to one aspect of the present concepts, a method of conducting a wagering game in connection with a persistent-state gaming environment, comprises the acts of operating a group game comprising a persistent-state gaming environment at a plurality of wagering game machines, creating an asset in the persistent-state gaming environment in association with a player or a gaming machine; and redeeming assets accumulated by a player in the persistent-state gaming environment.

In another aspect of the present concepts, a gaming system for playing a wagering game comprises a plurality of gaming machines configured to receive a wagering input and to access a group game comprising a persistent-state gaming environment and a controller configured to maintain the persistent-state gaming environment and to control game play within the persistent-state gaming environment. The persistent-state gaming environment is configured to permit ingress and egress of players into and out of the persistent-state gaming environment.

In still another aspect of the present concepts, a method of conducting a wagering game in connection with a persistent-state gaming environment, comprising the acts of providing at least one gaming machine configured to access a network group game, dividing a group of players in the group game into a plurality of sub-groups, initiating a competition between the plurality of sub-groups to determine which of the plurality of sub-groups is eligible for an award, continuing the competition until one of the lapse of a predetermined period of time and an occurrence of a triggering event, and awarding the award to at least a last remaining sub-group.

In yet another aspect of the present concepts, a computer-readable storage medium or media is encoded with instructions for directing the gaming machines to perform the above-noted methods.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 1(*b*) is a perspective view of a handheld gaming machine embodying the present invention.

DETAILED DESCRIPTION

Figure 1A:
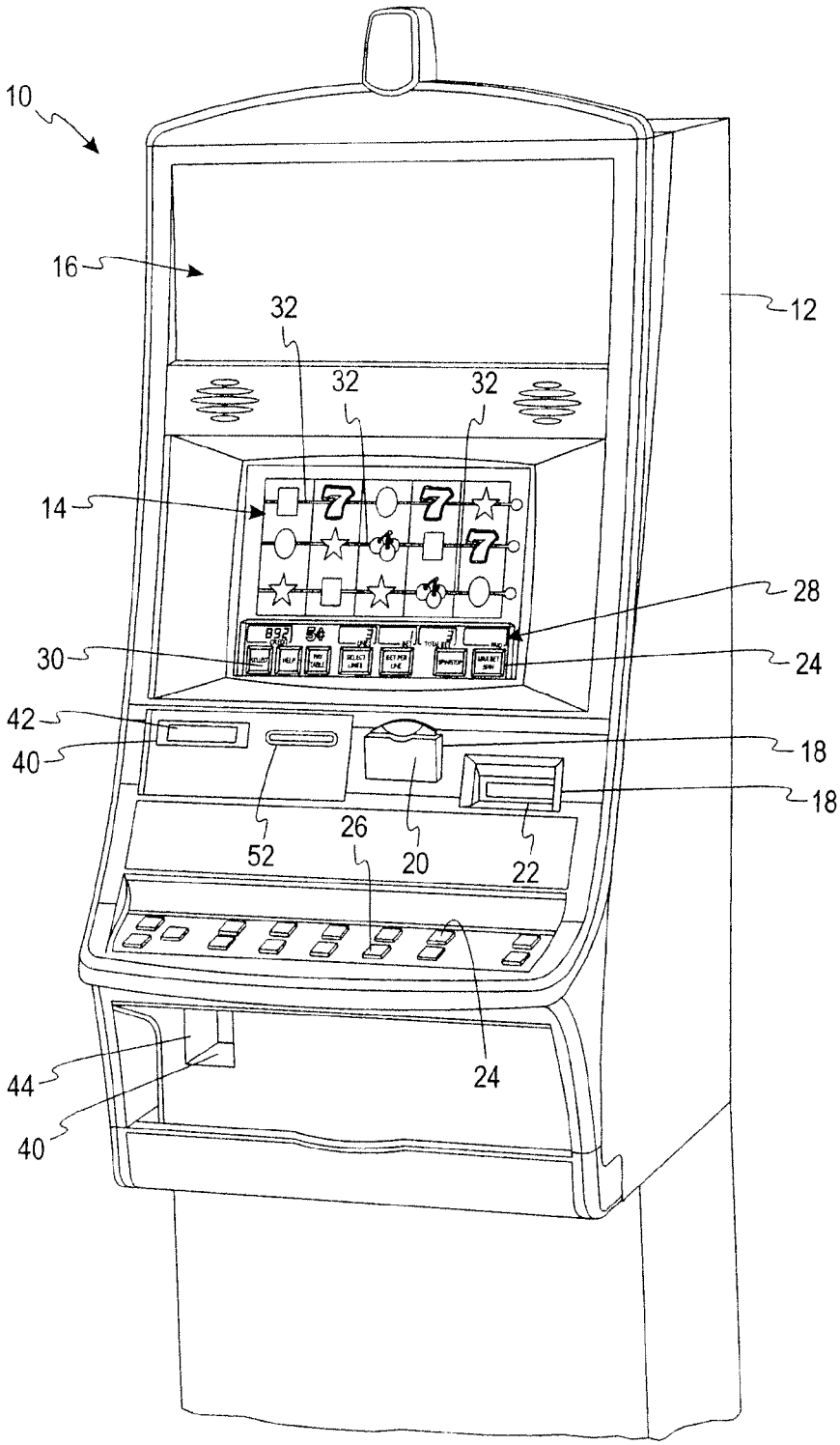
FIG. 1(*a*) is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
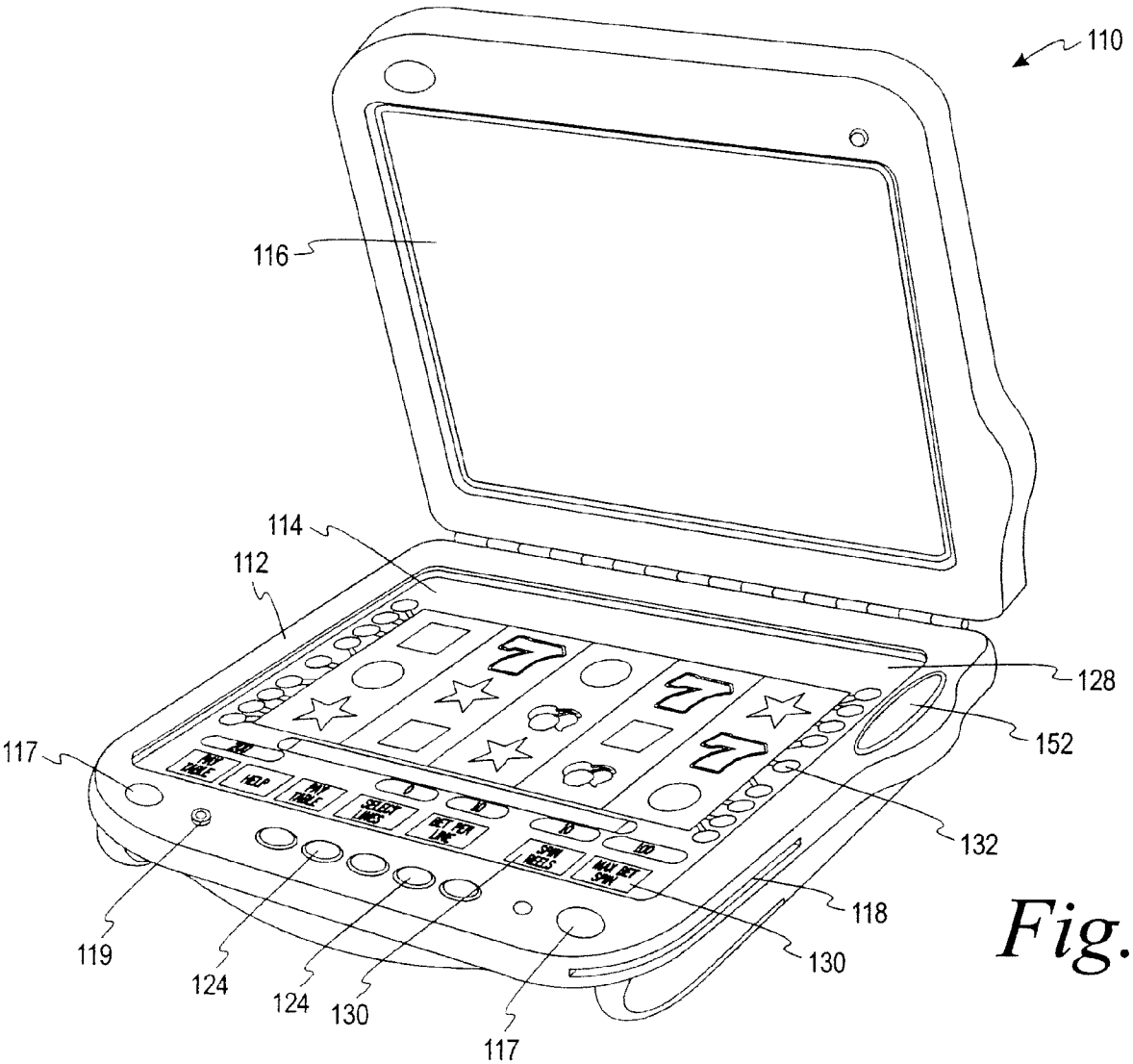

Referring to FIG. 1(*a*), a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1(*a*)). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1(*a*), or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one pay-line 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one pay-line 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1(*a*) as a card reader, but may take on many forms including a ticket reader, bar code scanner, biometric reader (e.g., fingerprint, voice ID, iris scan, etc.) RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Depicted in FIG. 1(*b*) is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, either or both of which may comprise a touch screen display 128, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1(*b*), the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display 128 (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1(*b*), or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the basic game may comprise a plurality of symbols arranged in an array, and includes at least one pay-line 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIGS. 1(*a*)-(*b*), comprises a biometric sensing device.

Figure 2:
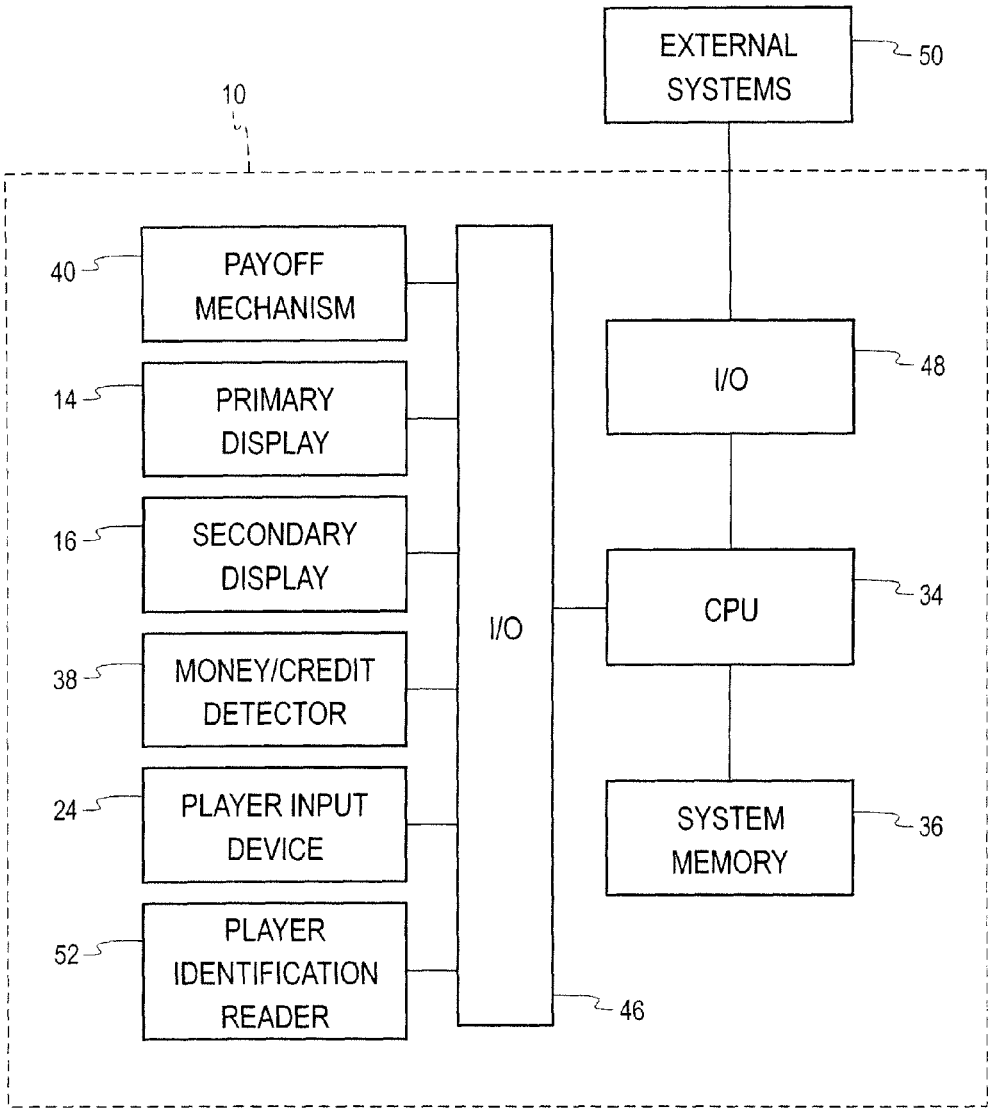
FIG. 2 is a block diagram of a control system suitable for operating the gaming machines of FIGS. 1(*a*) and 1(*b*).

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1(*a*), the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, and/or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal digital assistant (PDA), a counter top or bar top gaming machine, or other personal electronic device such as a portable television, MP3 player, entertainment device, etc In accord with at least some embodiments of the present concepts, shared gaming experiences that are persistent, at least to some degree, are presented in various gaming environments. In many instances, but not in all cases, these gaming environments exist after a player's individual participation has ended or has been paused and/or prior to the player's individual participation. Thus, in at least some aspects, the gaming environment is constantly running and changing responsive at least to continued play or to a presence of at least one player within the gaming environment or even in isolation (e.g., no players). Optionally, in some aspects of a constant or persistent gaming environment, the gaming environment continues to run and change irrespective of any player inputs. In other words, in such aspects, the controller(s) associated with the wagering game continue to process random events which may or may not alter the gaming environment in an appreciable way, even absent any player presence or input. However, it is to be understood that the present concepts also relate to persistent-state gaming environments that are ephemeral (e.g., lasting only a few hours, a day, a few days, a week, several weeks, lasting until a terminating event or terminating state, etc.). The persistent-state gaming environment, described by way of example herein, comprises an interactive environment wherein players are permitted to enter and leave the gaming environment, as desired, and to act within and/or interact with the environment and/or other players in the gaming environment, but would not include, for example, a conventional progressive game.

Figure 3A:
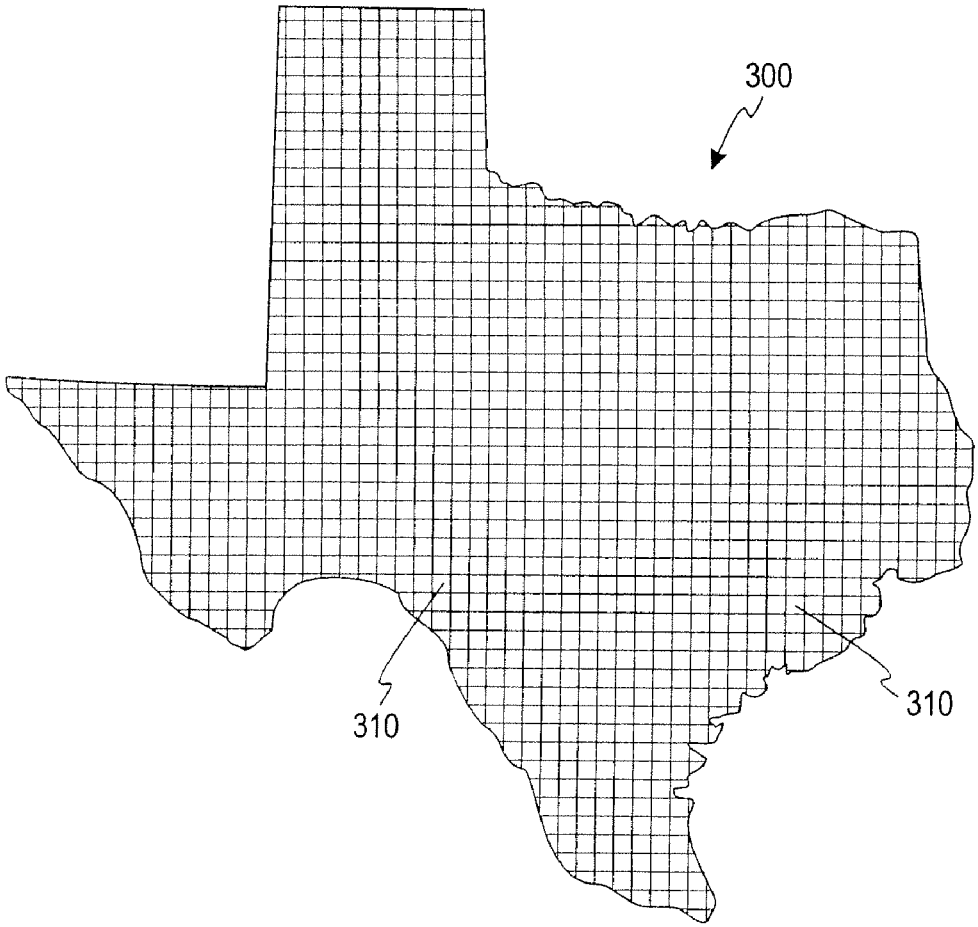
FIGS. 3(*a*)-(*b*) depict an example of a gaming environment in accord with at least some aspects of an embodiment of the present concepts.
Figure 3B:
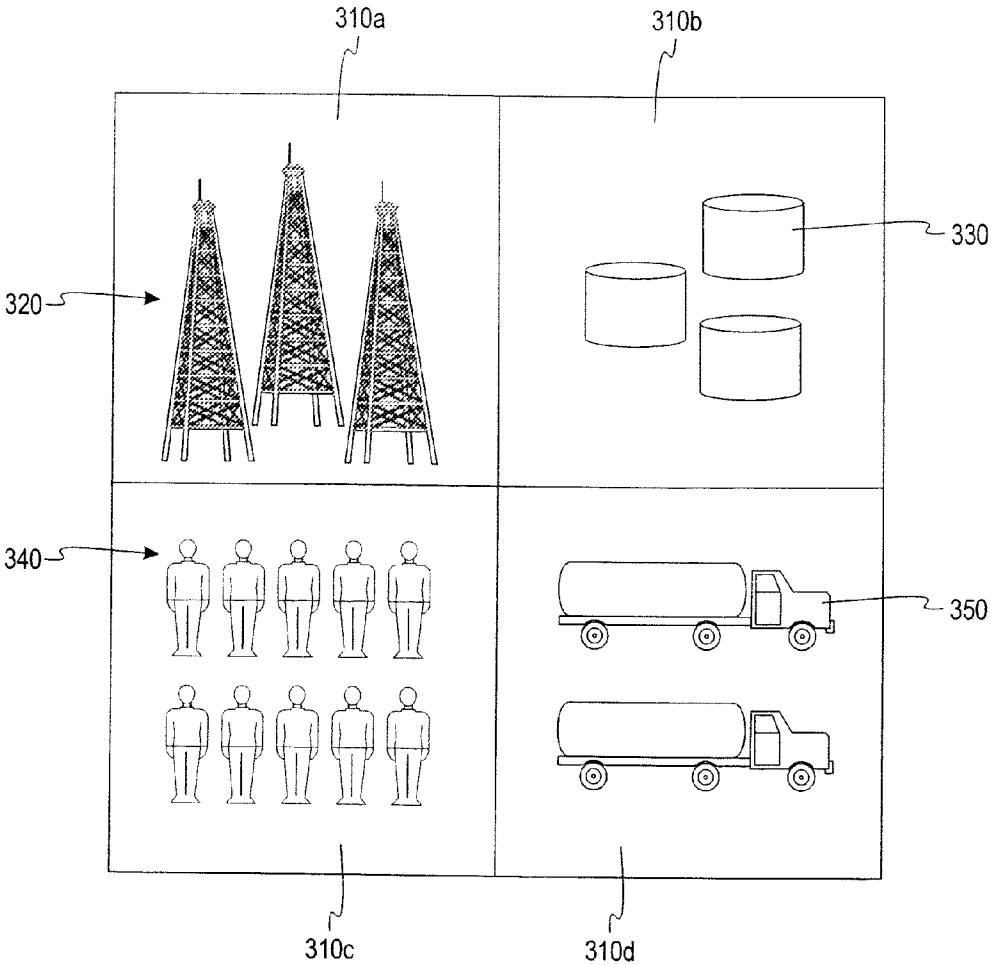

One aspect of a gaming environment 300 is shown in FIG. 3(*a*). In this example, the gaming environment 300 comprises a land-mass (e.g., the state of Texas). The gaming environment 300 is subdivided into a plurality of selectable sub-portions 310 that a player may acquire for the duration of the game, until lost by the player, or until the sub-portion is transferred by (e.g., sold, ceded, abandoned, bartered, traded, etc.) by the player to another player or to the controller. The sub-portions 310 are potentially, if not actually, natural resource rich environments wherein the players may capitalize on the resources associated with the sub-portions. Within this gaming environment 300, the player is, for example, to exploit, maintain, and/or develop a selected sub-portion 310, such as a parcel or parcels of land (e.g., drilling for oil, developing crops, developing infrastructure to increase property values, mining for jewels or coal, fishing, etc.).

The players are permitted to select a sub-portion 310 within the gaming environment 300, such as by direct selection of an available sub-portion. The players may alternatively permit the computer to randomly select a plot of land for the player within the gaming environment 300. Further, the players may select a gaming machine 10, 110 having a predetermined association with a sub-portion 310 within the gaming environment 300. For example, each wagering game machine 10, 110 represents a plot of land or designated plots of land in a gaming environment 300. Thus, in this aspect, the player's selection of the particular gaming machine 10, 110 is, correspondingly, a selection of the selectable sub-portion(s) 310 associated therewith. Additionally, tying the individual gaming machines 10, 110, either locally or remotely, to particular sub-portions 310 within the gaming environment 300 creates a limit to the total number of plots of land within the gaming environment, so as to limit the available land, introducing an element of scarcity. A preset maximum number of sub-portions 310 may also be used to limit the amount of available land (or other commodity consistent with the selected gaming environment 300) to a preset arbitrary maximum, to the same effect.

In at least some aspects of embodiments of the present concepts, the players may be required to start with no land and/or no commodity or assets within the selected gaming environment 300. During game play, the players are permitted, through various random outcomes and/or enabling events to acquire land and/or no commodity. In at least some other aspects of embodiments of the present concepts, the players may be permitted to acquire land and/or commodity and/or assets through an on-line (remote or local) connection through an in-game or external merchant solution. Thus, a player desiring to enter a gaming environment 300 at a certain state (e.g., amount of land, commodities, and/or assets, or the like) may log into a gaming environment 300 external merchant solution, an internal gaming environment economy, or the like to acquire the desired land, commodities and/or assets.

Once selected, in whatever manner, the selected sub-portion 310 (e.g., land) is then associated with the player (or gaming machine 10, 110). In some aspects, a player may be associated with more than one selectable sub-portion 310. For example, in at least some aspects, the number of selectable sub-portions 310 that a player may "acquire" is related to a buy-in or coin-in (e.g., rate of coin in) by the player, with greater amounts of buy-in or coin-in corresponding to greater numbers of such selectable sub-portions 310 and/or selectable sub-portions being associated with higher than average odds as compared to at least some of the remaining selectable sub-portions.

In some aspects, the selectable sub-portions 310 are exclusive to a player and are subject to (direct) exploitation by only that player. Optionally, one or more (e.g., all) of the selectable sub-portions 310 are open and are able to be shared by more than one player. Thus, the odds, awards, and/or benefits associated with a particular one of the selectable sub-portions 310 may be equally conveyed, or proportionally conveyed (e.g., in relation to buy-in or coin-in), to each of the players associated with that particular selectable sub-portion of the gaming environment 300.

However, depending upon the desired gaming experience, the selectable sub-portions 310 may alternatively represent different types of gaming environments 300 such as, but not limited to, areas of water (e.g., surface water-based gaming environment), volumes of water (e.g., undersea gaming environment), or areas of space (e.g., space-based gaming environment), or any combination thereof. In at least some aspects, gaming machines 10 may be optionally spatially arranged to correspond to the arrangement of the gaming environment 300.

In at least some embodiments of the present concepts, the activities of the player on the selectable sub-portions 310 (e.g., land) are either selected by the player from a plurality of options. For example, the player is permitted to choose whether to exploit, maintain, and/or develop a selected parcel or parcels of land. The player may then optionally be provided a plurality of subcategories for each of those (or other) categories. For example, if the player chooses to develop the land, the player may be presented with the options of developing infrastructure, housing, or raising crops. The population of reel symbols in the game may dynamically change in accord with the player's selections of options. If the player opts to raise crops, for example, the subsequently displayed reel symbols (e.g., on a video reel) would, until otherwise altered by the player, relate to the farming. If the player opts to build housing, for example, the subsequently displayed reel symbols (e.g., on a video reel) would, until otherwise altered by the player, relate to housing and construction. The player may be advantageously prompted, at each instance of asset generation in the gaming environment 300, to elect to continue development in the manner previously indicated or to engage in a new endeavor. Even in such aspects, common reel symbols (e.g., common to the gaming environment 300 in general) could still populate each of the reel symbol sets. Random events within the gaming environment 300 may then affect the player's parcel or parcels of land and, based on the players selection(s), such random events may affect the player's parcel or parcels of land differently than had the player selected other ones of the available options.

Winning outcomes on the gaming machine 10, 110 advantageously produce assets in the gaming environment 300, in association with the player, that are alterable, positively or negatively, in whole or in part, by events in the gaming environment. Certain winning outcomes, however, may optionally produce "permanent" assets within the gaming environment 300, in association with the player, that cannot be lost or diminished through the action of any possible negative events within the gaming environment. Such permanent assets may optionally be susceptible to positive events within the gaming environment 300 which would enhance the value of such asset. Further, just as the gaming machine 10, 110 includes reels bearing various symbols that may produce "winning" outcomes associated with the creation of assets in the gaming environment 300, gaming machine reel symbols may also be provided as modifiers to past "winning" outcomes which have not yet been realized in the "real" world. Stated differently, the assets in the gaming environment 300 are not actual awards that have been distributed to the player, but are rather potentials for awards until realized (e.g., redeemed) by the player for currency or credit. The players retain their assets in the gaming environment 300 in the hope that the maintenance of such assets in the gaming environment will provide a greater return on their investment than if they were to have simply redeemed their assets at an earlier time.

For example, the development of the player's land is performed responsive to reel outcomes along an active pay-line (e.g., three crop symbols along an active pay-line produce crops on the player's land) or, optionally, anywhere on the symbol array. Optionally, in at least some aspects, rather than an immediate award to the player, the development and fruition of the award takes a specific period of time or a randomly generated time within a specific range of times. For example, using the above crop example, the occurrence of the three crop symbols along an active pay-line corresponds to the planting of crops on the player's land. The player does not get a "crop bonus" until the crops are actually harvested, which only occurs a predetermined number of plays after planting (e.g., between 20-30 plays, etc.). During such time, events randomly occur within the gaming environment 300 that may increase the value of such potential (e.g., a drought or famine in other parts of the gaming environment which drive up the value of food) or decrease the value of such potential (e.g., a drought, pestilence, and/or flood strikes the player's land). These events may be randomly generated by the game controller (e.g., 34), separate and apart from any outcomes on the player's gaming machine 10, 110, or may arise from a randomly generated outcome on the player's gaming machine. For example, continuing the above example, 15 plays after the player obtains the three crop symbols along an active pay-line, the player obtains a grasshopper symbol along an active pay-line. Grasshoppers would then appear on the player's land and eat a portion of the crops prior to harvest, diminishing the value of the "crop bonus" yet to be realized. Using the example of the oil derricks, a broken oil derrick symbol could occur along an active pay-line with a corresponding breakage of one of the player's oil derricks.

When the player logs into the gaming environment 300, the player is able to, as noted above, select one or more of the selectable sub-portions 310 (e.g., by direct selection of the gaming machine, direct selection of the selectable sub-portions 310 via a player input device, etc.). In the example of FIG. 3(*b*), player one has three oil derricks 320 on his or her selected sub-portion 310*a* (i.e., land) of the gaming environment 300 based on the occurrence of one or more "oil derrick" winning outcomes. As player one plays a gaming machine 10 associated with the selected sub-portion 310 of the gaming environment 300, random outcomes on the gaming machine have the potential to influence, positively or negatively, the value of or realization from the player's selected sub-portion 310. For example, a "dust storm" symbol may occur on an un-selected pay-line and trigger a virtual dust storm on player one's selected sub-portion 310 and take one of his or her oil derricks 320 away to leave two remaining oil derricks. In at least some aspects, the negative potential may only be realized when a symbol associated with a negative (e.g., potentially value decreasing) event occurs along an inactive pay-line (i.e., a negative symbol occurring along an active pay-line will be nullified and will not yield a negative event).

In this way, the player's selected sub-portion 310 (e.g., land) may "mature" as time goes on responsive to the influence of external conditions, which may be influenced in whole, in part, or irrespective of, game events or outcomes on the gaming machine 10, 110 (e.g., reel outcomes, bonus games, purchased land from a land/deed server, etc.). As one example, the gaming environment 300 and/or player's selected sub-portion(s) 310 may optionally change over time to provide a fresher and ever-changing sense of game play. In such aspects of the present concepts, the game itself may include changes to the gaming environment 300 and/or sub-portion(s) 310 thereof that alter the total experience for one or more players. In one example, the gaming environment 300 may consist essentially of a farm game. Then, a player randomly strikes oil. The remaining players then start digging for oil and the gaming environment 300 shifts into an oil-based game. Alternatively, the scale of such an alteration of the gaming environment 300 may be more localized. In such aspect, one or more sub-portions 310 within the gaming environment 300 are transformed or modified to alter the gaming experience for the players on such sub-portions. By altering the gaming environment 300 and/or sub-portion(s) 310 in this manner, players can return and discover new and refreshing gaming environments and/or possibilities.

Positive events and/or negative events may not only be randomly triggered on the player's selected sub-portion 310 within the gaming environment 300 responsive to a random outcome on the player's own gaming machine 10, 110, but may also be randomly triggered by the game controller (e.g., 34) and/or by random outcomes occurring on one or more of the other gaming machines associated with the gaming environment 300. Thus, using the above example of a dust storm, another player could receive a random outcome triggering a dust storm that, rather than being localized on that player's selected sub-portion 310, is disposed on a randomly selected sub-portion 310 within the gaming environment 300.

The gaming environment 300 may optionally be artificially limited to provide for simplistic game play. For example, in one embodiment, oil exploration is the single activity upon which each of the player's is potentially engaged upon the player's selected sub-portions 310 (e.g., land). Random outcomes in a basic game, such as noted above, populate and/or depopulate the player's selected sub-portions 310 with oil derricks 320 and, optionally, attendant resources required to fully enable production from such oil derricks (e.g., workers 340, storage facilities 330, transportation 350, and/or other resources, etc.). Players desire to make their selected sub-portions 310 as productive as possible so that, when an optional bonus prize (e.g., a Big Event) is triggered within gaming environment 300 for distribution to one or more of the players based on a player's participation in and/or state/status in the gaming environment 300, they are in the best position to receiving the largest possible share of the distribution of the bonus prize. For example, the bonus prize may comprise a predetermined jackpot amount or a variable jackpot amount such as, but not limited to, a progressive award. In one example, the bonus prize is distributed to all of the participants in the gaming environment 300 in proportion to the production capacity of the oil derricks 320 on each particular player's selected sub-portion(s) 310, such capacity being measured by one or more factors.

It is to be emphasized that even though assets appear in the gaming environment 300 in association with the player, such winnings have not, in fact, been paid to the player and represent a potential for award. The player is maintaining such potential within the gaming environment 300 in anticipation of even greater rewards flowing therefrom and thus, in effect, is engaged in a continuing wager. Numerous events, both positive and negative, may occur to affect the players assets within the gaming environment 300 during the bonus event (e.g., the Big Event) or even before the bonus event occurs. For example, an event may occur (e.g., thunderstorm, wild bull, etc.) that may chase a worker or workers off of the screen to the detriment of production.

Instead of an game based on individualistic self-determination (and luck), wherein each participant is competing against all of the other denizens of the gaming environment 300, the gaming environment may be advantageously divided into competing groups or camps (East vs. West, blue vs. red, etc.). These competing groups or camps are, in some aspects, randomly populated by the controller (e.g., 34) to maintain substantial parity between the numbers in the groups as players leave and enter the gaming environment 300. In other aspects, the controller (e.g., 34) is adapted to maintain one or more performance measures at a substantial parity between the groups in the gaming environment 300 to prevent imbalance, the perception of imbalance, or to prevent gaming of or undue influence over the system.

In such persistent-state environments, a player may, if desired, "cash out" by selling his gaming environment 300 assets back to the gaming system (e.g., back to the house). The gaming system, in turn, may optionally maintain the assets on the property and offer the property "as-is" to a prospective purchaser (e.g., a new player of the gaming machine). A new player may thus take over where a prior player left off. A new player may, instead, opt to start anew and, in such instance, the controller may cause a disaster (e.g., a tornado) to befall the property to clear the property for the new player.

The competing groups or camps may be geographically separated, such as by a mountain, river or body of water, or may be geographically intermingled, yet distinct. For example, the gaming environment 300 is advantageously displayed on a gaming machine secondary display (e.g., 16) and on an area display (e.g., a very large display or collection of displays). Within the gaming environment 300, the land occupied by a player, or icons or images on such land (e.g., a flag), are represented as blue or red. Within the gaming environment 300, each of the players sets themselves up as best possible in anticipation of the coming of the bonus prize, such as a Big Event. In at least some aspects of the overall competition, the bonus prize is only awarded to and distributed among only one of the groups, although in other aspects a lesser consolation prize may be provided to the "losing" group or groups.

In accord with the above examples and embodiments, the gaming environment 300 is akin to a real-time, persistent-state world wherein the values of the selected and selectable sub-portion(s) 310 varies responsive to changing conditions within and among the selected sub-portion(s) and within the gaming environment in general. Players are free to enter and exit at will (e.g., cash out, log out with assets in-play, log out with assets in-stasis, etc.). In this gaming environment 300, every player introduces different variables and game dynamics to provide a refreshing, ever-changing game experience.

In more complex embodiments, different natural resources may be associated (e.g., randomly associated) with different selectable sub-portion(s) 310. Players may, moveover, be enabled to interact with one another (e.g., text messaging, pop-up messages, etc.) to form alliances or partnerships to combine resources for the betterment of both players. In aspects of the present concept utilizing an optional bonus prize such as, but not limited to, a Big Event, player one on selected sub-portion 310*a* has ample oil derricks, but no storage or transportation facilities, as shown in FIG. 3(*b*). Player two on selected sub-portion 310*b* has no oil derricks, but has ample storage facilities 330. Player three on selected sub-portion 310*c* has workers 340, but other assets. Player four on selected sub-portion 310*d* has transportation capacity 350. Since none of these players knows when the bonus prize may occur, and since each of the players knows that the bonus prize will be awarded, in this example, based on a factor such as, but not limited to enabled production, players one through four may partner-up to provide, in this example, a fully-enabled production so that, should the bonus prize be triggered before either players one through four can independently develop the necessary resources to enable production, all of these players can collectively benefit from the bonus prize. Such benefit could be equal, established based on the lowest common denominator of production, or could be established based on negotiated agreements between the players.

In other aspects of the interaction between players of adjoining properties, player one and player two cold each stake out a small plot of land one corner of the gaming environment 300 and individually exploit, maintain, and/or develop their selected parcel or parcels of land and acquire adjacent land. At some point, a conflict may ensure between player one and player two. The conflict could be any conventional or manufactured conflict between adjoining landowners. For example, it could involve trespass of cattle, damage to a fence, or a range war or dispute over property lines. The dispute could be settled, in at least some aspects, by the ability of each of the conflicting parties, here player one and player two, to achieve some objective within a specified period of time or to be the first to achieve such objective. The objective could simply be to be the first player to obtain a certain winning combination or symbol which may be depend, for example, on the nature of the conflict. Thus, if the dispute is over a fence, the victor may be the player that first obtains a fence symbol across an active pay-line. Alternatively, the time frame may be set to a period of hours, days, or weeks. In that time period, the victor in the conflict depends, for example, at least in part on each players play totals. In still other aspects, the odds of winning are normalized by basing the decision on the victor on a formula that essentially removes the magnitude of coin-in or credit-in as a factor (e.g., a percentage of winnings vs. bets placed, a success rate, etc.). In yet other aspects, the victor in the dispute may be determined, in whole or in part, based on the past or current performance of each of the players within the gaming environment 300.

Other more complex embodiments may actually comprise a gaming environment 300 economy wherein players are free to trade assets in the gaming environment without limitation, subject to the laws of supply and demand. Since it would not be known when a triggering event for a bonus event, such as a progressive or Big Event, might occur, a player who has an excess of a first resource (which might not have no value or marginal in isolation, but may have greater value in combination with a second resource), may elect to trade off an excess portion of the first resource in a free market for the second resource to increase the immediate overall value of the player's assets. Alternatively, such player could sell off an excess portion of the first resource in a free market for gaming environment 300 money, which the player could then use to purchase the second resource from another player or from the gaming system itself, such as an intermediary of the gaming establishment. Thus, particularly in games where eligibility of the player for a bonus event is based upon the satisfaction of a combination of conditions, rather than the mere maintaining of a predetermined rate of coin-in/credit-in, a free market economy within which players can optionally seek to acquire and satisfy one or more of the conditions for eligibility is particularly beneficial.

In any of the aforementioned aspects, as well as other embodiments disclosed herein, a player is optionally permitted to save a state of his or her position, assets, or any other characteristic of the player's selected sub-portion(s) of the gaming environment 300 and assets associated therewith as a persistent-state in a memory device. The player's persistent-state may be saved to a portable electronic device and/or within a memory associated with the external systems 50. Upon a later resumption of play by the player, the player may log-in into the gaming environment 300 and reinitiate play at the point that he or she previously left the gaming environment, although the remainder of the gaming environment will have since changed. In some aspects, the player's persistent-state will be altered to an equivalent state to accommodate changes to the gaming environment.

In another type of gaming environment 300, the activity in the gaming environment is not completely tied to the slot expected value (EV) and, for every winning outcome on a slot machine, an award-independent outcome is generated in the gaming environment 300. In one example, the gaming environment 300 is a town, a room, a city, or the like, depicted on the gaming machine (e.g., 10, 110) secondary displays (e.g., 16, 116) and area display(s). Upon satisfaction of a precondition, such as a win at a gaming machine 10, 110 or an input of a minimum predetermined amount of coinage/credit, a new virtual person is introduced into the gaming environment in association with the player. The virtual person may be any representation including a circle, stick figure, animation, or the like, or any other representation of a person or other object consistent with a theme of a game. The players may optionally be permitted to select a virtual person from among a plurality of available virtual persons. Every time the precondition is again satisfied (e.g., another win) another virtual person is produced in the gaming environment 300. As the players continue to wager, the virtual persons wander around the gaming environment 300 interacting with the gaming environment and possibly with other virtual persons. In some aspects, the activity in the gaming environment 300 may provide only entertainment value. In other aspects, the activity in the gaming environment 300 may have positive consequences for the player. For example, in one embodiment, the virtual persons may, in-turn, be representations of people also gambling at a slot machine. The virtual person associated with the player will also play "virtual" wagering games and provide a potential for a secondary win for the player at some future time. Thus, a win for the virtual person in the gaming environment would provide an award to the player. In some aspects, all of the players are playing for a mystery progressive that will be triggered at some random point within a range of values. In a related sense, the virtual persons that are associated with a particular player could be simultaneously "playing" for a secondary, smaller mystery progressive or progressives funded by the coin-in/credit-in of the players.

Figure 4:
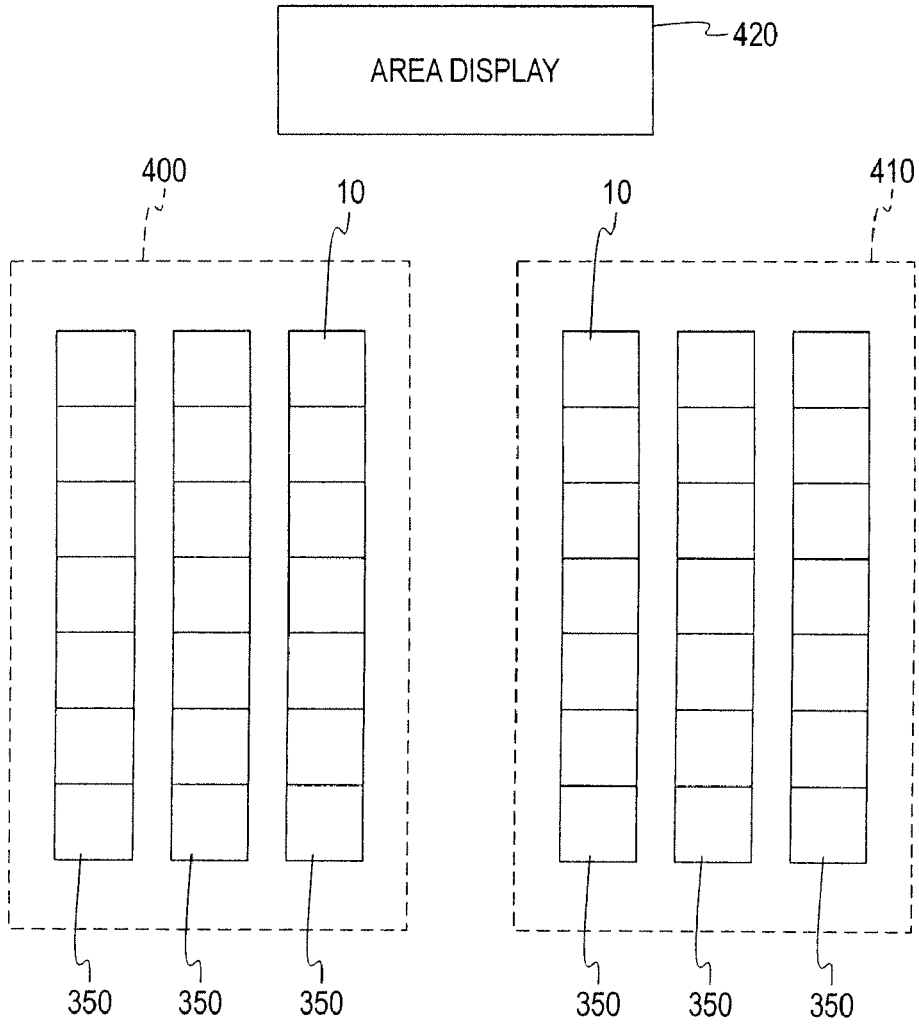
FIG. 4 depicts another example of a gaming environment in accord with at least some aspects of an embodiment of the present concepts.

In still another embodiment, the gaming environment 300 comprises a battle-themed game wherein two or more groups of players (e.g., ship A vs. ship B, army A vs. army B, etc.) compete against one another. The groups 400, 410, shown by way of example in FIG. 4, could represent any desired theme such as, for example, opposing factions of Star Fleet vs. Romulans vs. Klingons or Pirate group A vs. Pirate group B, or the like. In one physical arrangement, banks 350 of upright gaming machines 10 are disposed in a tiered arrangement (two banks or three banks) in opposition to one another, each grouping 400, 410 of the banks of gaming machines representing one ship (e.g., a pirate ship, starship, etc.), such as is represented by FIG. 4. In this embodiment, each bank 350 represents one tier of guns or cannons on a ship. The players may select their ship (e.g., 400, 410) simply by selecting an open machine in the desired bank 350 of gaming machines 10. Alternatively, each bank 350 may represent a different group. A larger than life area display 420 is advantageously disposed adjacent the groups 400, 410 to permit all participants to view the action.

Various game mechanics may revolve around the opposing groups 400, 410. In one example, each player in a group amasses wealth, arms, speed, provisions, defense/armor, and/or experience/rank through the occurrence of random winning outcomes (e.g., along an active pay-line) on the player's gaming machine 10. As each player contributes to the collective wealth, arms, defense, speed, provisions, and/or experience/rank of the group as a whole (i.e., the crew of the ship), the group increases in stature. The experience/rank may permit, for example, better odds of successfully aiming or wielding weapons, more rapid rates of fire or attack, and/or greater inflicted damage per hit. Enhanced arms may permit, for example, greater range, rates of fire, damage and/or accuracy.

In an embodiment employing a Big Event, a triggering of the Big Event causes the multiple groups 400, 410 of players (e.g., ship A, ship B, etc.) to compete against one another for all of the Big Event prize or for a portion thereof. The outcome of the Big Event may be determined by the relative wealth, speed, provisions, arms, defense, and/or experience/rank prior to the triggering of the Big Event or may be determined by or influenced by the actions of the players during the duration of the Big Event. For example, in an embodiment wherein the rate of credit-in or coin-in during the Big Event is a factor in victory, ship A (e.g., group 400) may have greater arms and experience than ship B (e.g., group 410), but may be unable to bring those advantages efficiently to bear against ship B if the rate of credit-in or coin-in in ship B during the Big Event is significantly higher than that of ship A. In other words, the rate of credit-in or coin-in during the Big Event may be likened to the volleys of fire emanating from ship B. At the conclusion of the Big Event, the Big Event prize would be awarded to the victorious ship. In other similar embodiments, wherein there are more than two groups 400, 410 representing different ships, weaker ships may communicate with one another verbally or electronically (e.g., through a commanding officer, the highest ranking member of the crew), and form alliances to pit their combined forces against that of a stronger opponent. For example, ship A and ship B could team up against ship C and, if victorious during the Big Event, the Big Event spoils would be divided between ship A and ship B.

Other non-violent embodiments could include, for example, treasure hunts, wherein ship A and ship B land on different portions of an island gaming environment 300 and follow clues obtained by the group members as to a location of a buried treasure. The Big Event may then manifest as a race between groups to close the gap between their group and the buried treasure.

In another aspect, the competition between groups 400, 410 could comprise a tug-of-war game wherein actions by each of the participants and/or outcomes achieved by each of the participants weighs into the tug-of-war. An area display or displays, as well as the gaming machine 10 secondary displays 16 provide a visual representation of the tug-of-war to clearly show each side who is winning. At time zero, a virtual marker is disposed equidistantly from the finish lines for each of the teams. Since the players have no real weight and cannot exert any real forces, the game play itself may advantageously assist in the determination of the winner, although it could be determined randomly. In one aspect, the rate of coin-in/credit-in can factor in as a weight or a momentum, whereas each win by each of the players can factor in as a tug. For example, a player in Group A achieves a winning outcome of significant magnitude. The virtual rope in the gaming environment 300 is then given a might tug by Group A and the flag or marker on the virtual rope is moved toward the finish line for Group A. Once a victor has been determined, the winner triggers a bonus event (e.g., a Big Event) for the winners.

In various aspects of the pirate game, the characteristics of each of the players in each of the groups may optionally revert back to a default level at the end of the Big Event. In alternative aspects, a player may retain one or more of the accumulated wealth, speed, provisions, arms, defense, experience/rank, and/or other characteristics prior to the triggering of the Big Event, as may be modified during the Big Event. For example, during a Big Event Battle between opposing ships, a player's provisions, arms, and wealth may be lost, but the player may be determined by the controller to have "survived" the battle to go on to fight another day and may retain certain of the characteristics (e.g., experience/rank) and may actually increase in such characteristic as a result of the experience. The longevity of any such characteristics in a persistent-state is entirely determinable by the game designer any may last until the conclusion of a Big Event, for the duration of a player's continued play (with or without interruption), or for a predetermined period of time.

The above-described embodiments describe examples wherein team play is fostered by a close physical proximity, which enhances not only the camaraderie of the different groups, but also provides increased enjoyment in the conflicts between groups—a fun and congenial manner of conflict.

In any of the embodiments herein, a unique currency system may optionally exist in the gaming environment 300 which is used in the same capacity as currency is used in the real world. One subset of the currency-based system is simply a barter-based trading system. For example, in the above-described example of FIG. 3(*b*), wherein each of players one through four have capacity in one resource, but substantially lack in another or others, any of the players could have opted to barter for needed resources rather than form a partnership. In other words, player one could have traded a portion of his or her oil derricks 320 for a portion of player two's storage facilities 330, a portion of player three's workforce 340, and/or a portion of player four's transportation capacity 350, and/or vice versa. In other aspects, the currency-based system comprises a unique monetary medium (e.g. money) to facilitate or permit exchanges for goods, services, good will, forbearance, or any other purpose to which money is normally used. Players may optionally be permitted to convert U.S. Dollars, or some other real-world currency, into an established equivalent value of money in the gaming environment 300. In another aspect, conversion of U.S. Dollars, or some other real-world currency, into money in the gaming environment 300 may be prohibited. In such case, an economy may be permitted to function outside of the gaming environment 300 wherein players sell, trade, and/or auction-off (e.g., online, direct transfer via portable electronic devices, assignment through the controller, etc.) persistent-state aspects within their dominion.

Figure 5:
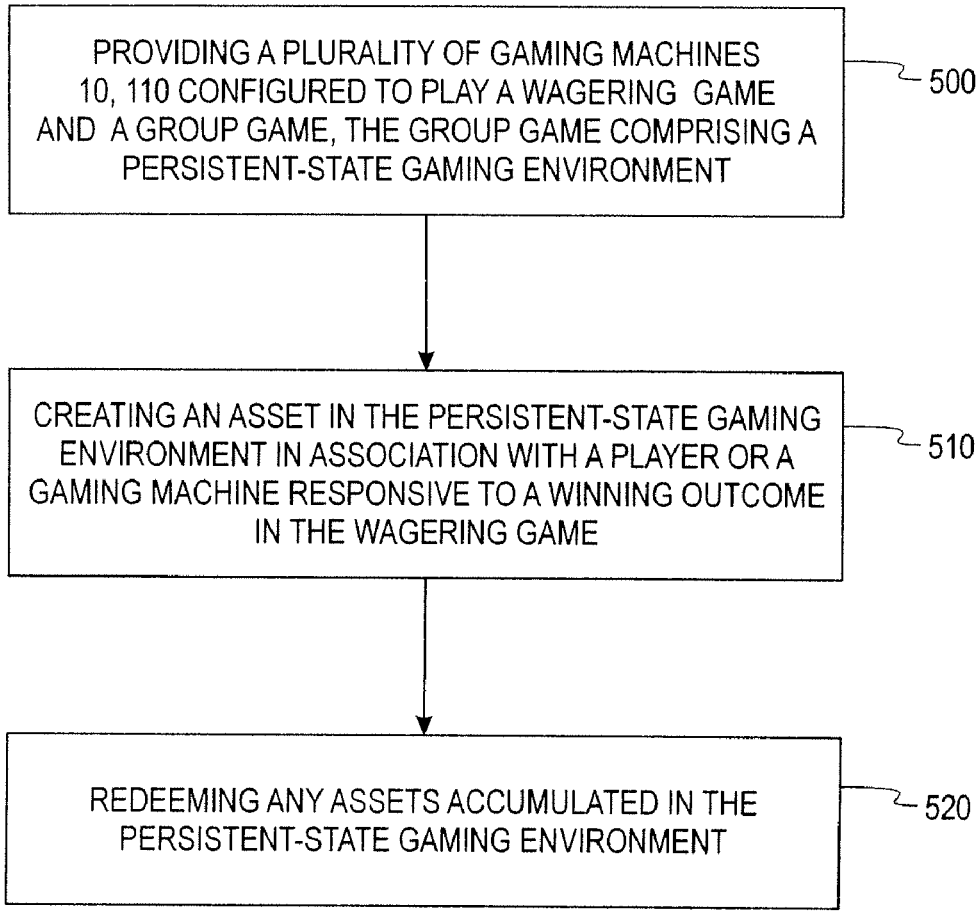
FIG. 5 is a flowchart of method steps according to at least some aspects of an embodiment of the present concepts.

FIG. 5 shows an example of a method of conducting a wagering game in connection with a persistent-state gaming environment in accord with the present concepts. This method includes the act 500 of providing a plurality of gaming machines 10, 110 configured to play a wagering game and a group game, the group game comprising a persistent-state gaming environment 300, such as is described by way of example herein. The method also includes the act 510 of creating an asset in the persistent-state gaming environment in association with a player or a gaming machine responsive to a winning outcome in the wagering game. The method further includes the act 520 of redeeming any assets accumulated in the persistent-state gaming environment 300. The player may "cash-in" or redeem his or her assets in the persistent-state gaming environment 300 with the game controller (e.g., 34) or external systems 50 at any time and exit the persistent-state gaming environment. As used herein, the term redeem includes not only redemption with a central authority, but also includes other transactions wherein assets are converted into another form either within or outside of the persistent-state gaming environment 300. Such redemption may be electronic, to be credited to an account of the player's choosing, or may comprise a value associated with an output medium, such as an encrypted voucher or ticket printed on a security-paper. In at least some aspects, the redemption may comprise a peer-to-peer or player-to-player transaction or a transaction between a player and a third party other than the gaming establishment.

In another example, a method of conducting a wagering game in connection with a persistent-state gaming environment comprises the acts of operating a group game comprising a persistent-state gaming environment at a plurality of wagering game machines, creating an asset in the persistent-state gaming environment in association with a player or a gaming machine, and redeeming assets accumulated by a player in the persistent-state gaming environment.

Additionally, while the above examples have focused on the larger scale interactions between a number of groups (e.g., 2, 3, 4, or more), smaller scale interactions may also take place between participants within a group, between participants of different groups, or combinations thereof. As one example, players may be permitted to choose a progressive group in which they want to participate or, alternatively, players are moved into a progressive group that is appropriate for their wager to give them a chance for a progressive award of an amount or size corresponding to their wager. Larger wagers will generally provide eligibility for potentially larger progressive awards. It at least one example of such aspects of the present concepts, all players in a given group are in different pools, each with a separate progressive. Players are provided the choice of switching pools within their group, to provide eligibility for a larger progressive. In one aspect of this example players in the pool are required, at some point, to directly compete with one another, with the winner of the competition receiving the progressive award. The triggering point for such competition may be entirely random or may be based on one or more game play factors such as, but not limited to, the number of players in the pool (e.g., more players provides a greater chance that the triggering point will be realized more quickly). For example, each player may have associated with him or her a fixed, variable, random or calculated percentage of a trigger and each player added to a pool therefore increases, to some degree, the change that the trigger will be realized.

In one example of such smaller-scale interactions, two players (e.g., within a group or in different groups) are put into direct competition for a bonus prize. The players may be, for example, randomly selected upon the initiation of a single triggering event or each player may separately trigger their own participation in the direct competition, such as by each obtaining one or more symbols across an active pay-line that are associated with the direct competition (e.g., a skull and crossbones for the pirate-themed game). When the direct competition is between members of opposing groups, this type of interaction is akin to a skirmish and can work up the friendly competition and excitement between the opposing groups as a prelude to the Big Event.

Another example of a smaller-scale interaction comprises a notification of a subset of the larger group(s) that the members of the subset have become eligible for a bonus prize such as, but not limited to, a progressive award. The subset may comprise selected players within a single group or may comprise selected players in two or more different groups. The notification to the selected members of the subset of players could comprise any means of notification (e.g., text messaging, e-mail, letter, hand delivery of a letter in a bottle to a player in a pirate-themed game, etc.). In some aspects, the notification may include a message stating, for example, that "Congratulations! You're one of X players eligible for a special progressive!" The notification may optionally indicate the set of members from which the player was selected to convey to the player the magnitude of the player's good fortune. For example, in a pirate-themed game, the notification may say something along the lines of "We selected YE an' one other hand from amongst all ye shipmates!"

The notification also preferably states any further conditions, if any, such as, but not necessarily including or limited to, a time limit and/or any performance measure to be satisfied subsequent to the notification. For example, the notification may inform the selected player that in a predetermined period of time (e.g., 1 day, 2 days, 3 days, . . . 1 week, two weeks, etc.) a final drawing will be conducted or a final determination of the winner of the bonus prize (e.g., a progressive award, etc.) will be made. The winner may be randomly selected. However, as noted above, optional performance measures may be imposed as a precondition for or a factor in the determination of the winner. To remain within the subset of eligible players, the selected players are optionally required to met periodic requirements (e.g., a threshold coin-in every day) or a fixed requirement (e.g., a total amount of coin-in prior to the determination of the winner). In still other variants, the odds of winning are normalized by basing the decision on the winner on a formula that essentially removes the magnitude of coin-in or credit-in as a factor (e.g., a percentage of winnings vs. bets placed, a success rate, etc.). In yet other variants, the eligible players are thrust into a direct competition wherein the first player to accomplish a certain object, such as obtaining one of each symbol across an active pay-line (e.g., to fill a bingo-card type marker), obtaining a particular symbol across an active pay-line, achieving a certain winning combination across an active pay-line, achieving a certain plurality of winning combinations across an active pay-line, achieving a certain sequence of symbols in a reel position across an active pay-line in successive spins, or the like. Alternatively, the above noted objects, such as but not limited to, the obtaining of one of each symbol across an active pay-line serve as a singular milestone or as one of a plurality of milestones that must be achieved to maintain eligibility for the determination of the winner (e.g., a random selection of remaining eligible players).

In yet other embodiments, the gaming environment 300 may largely self-defined by the players to provide a sense of community to the extent that each player desires such community. The gaming environment 300 provides a plethora of groups, clans, or communities (hereinafter "group" for brevity) having different names and/or characteristics to which each player may optionally associate. Alternatively, a player may opt not to associate with any of the defined groups and may instead choose to remain independent or start a group of his or her own. In this gaming environment 300, players who are friends or gaming acquaintances may log into the gaming environment and optionally associate themselves with a group of his or her choosing. If Richard and Jeremy are two friends who play together in Las Vegas, but then Jeremy moves to New Jersey, Richard and Jeremy may still enter the gaming environment 300 from different locations and wager together to achieve some end, such as the obtaining of a bonus. Jeremy and Richard may in turn invite others, Michael and Vlad to join the group. It at least some aspects, the larger experience (e.g., the Big Event) is shared equally by all members of the group, whereas each member of the group is able to receive smaller individual awards (e.g., winning outcomes). For example, in the gaming environment 300, if a member of the group hits a progressive award, the progressive award is divided equally between the group members. This equality may be subject to a precondition, however, that all of the players bet equally and take equal risks. If the players in a group take disproportionate risks, wherein one of the players places side wagers or bets across more pay-lines than the remainder of the group, then the award associated with the larger experience is shared unequally, such as in proportion to the wagers or level of risk taken by each of the group members.

In some instances, large wagers may be provided a slight advantage, statistically speaking, over small wagers. Player's or groups who are betting more may be afforded an "edge," wherein the return percentage of the game is raised slightly. This provides an impetus for players to band together in a group to form an aggregate betting pool wherein all of the players in the group (e.g., 5 players, 10 players, 100 players, etc.) all agree that they will wager a certain way (e.g., at least a minimum specified wager over at least a minimum specified number of pay-lines). Collectively, the group may then benefit from its size and aggrandized wagering capability by enjoying a slightly higher return percentage. As, noted above, one or more players in the group may individually assume greater risks than the remainder of the players in the group and will, correspondingly, enjoy a greater share of any award realized by the group in proportion to such added risk.

In still other embodiments, players able to maintain a certain amount of coin-in/credit-in through the duration of a basic game main remain eligible for a bonus game or event. In one example, continued eligibility for the bonus event may require a coin-in/credit-in of $10/minute, or some other higher (e.g., $100/min) or lower amount. While a big better may have no problem maintaining this level or rate of wagering, many players may not be able to maintain this level of wagering. As noted above, a group of players may seek out one another in the gaming establishment or on-line in a gaming environment 300 or application layer and join together to collectively satisfy this coin-in/credit-in requirement in some combination. By maintaining this minimum level, the game EV may, overall, improve by several percentage points (e.g., 3%).

In some aspects, the gaming environment 300 is advantageously configured to only permit certain activities to be engaged in by a group exhibiting certain characteristics such as, but not limited to, a minimum number of players or a minimum value of coin-in/credit-in. Thus, Jeremy is in a gaming establishment in New Jersey on a Saturday night and his friends, Michael, Vlad, and Richard have unexpectedly not logged into the gaming environment 300. Jeremy, as an individual player, may be precluded from engaging in certain activities open to groups of four or more players (e.g., playing a game associated with a Big Big Jackpot). Consequently, Jeremy may opt to talk to other players in the gaming establishment in the vicinity of the game to assemble a new group or may anonymously join another group, such as by accessing a gaming environment 300 bulletin board akin to a match making service. On such bulletin board, interested players post information about themselves (e.g., desired wagers, level of experience, risk tolerance, etc.) or associate themselves with various predefined categories to permit other prospective players to gauge whether or not those other interested players would be suitable group/team members.

In at least some embodiments, the formation of a group is itself a persistent-state. For example, a group of friends registers as a group within the gaming environment 300. Performance characteristics of the players within the group, selected by the group members, are available for all members of the group to see and include, but are not limited to rankings of most winnings and/or highest success rate. Each of the players in the group may play independently of one another, but all players in the group are made aware of the performance of the other players, such as the occurrence of winning outcomes. Thus, if Jeremy gets a big win, he may optionally send electronic trash talk to his friends via text messaging or email. The controller may facilitate such trash talk by providing graphics concerning the winning outcome in an electronic format for electronic distribution. Thus, even if players in the group are not able to coordinate their schedules to permit simultaneous play, the players can each log into the gaming environment 300 or application layer and view the persistent-state information for the other group members to check on their status, ranking, messages, and the like. Additionally, during any gaming session wherein more than one member of the group is hosted within the gaming environment 300 or application layer, the players may be provided with a continual representation of the relative statuses of the other player(s), such as a pop-up, ticker symbol equivalent, or electronic messages. Thus, the gaming environment 300 or application layer maintains a persistent-state of the group and characteristics related to the individual group members and characteristics of the group as a whole (e.g., name, schedule, friends, comparable groups, etc.). Thus, when a group is playing together the controller (e.g., 34) may arrange bracket tournaments with similarly situated groups.

Persistent-state group environments, such as those discussed above, provide a dynamic environment wherein a group of players is enabled to work together in a conditional state to achieve goals and enjoy experiences that differ from, and in some instances are better than, that available to individual players.

In at least some aspects, the gaming environment 300 itself could comprise a representation of a progressive event. A percentage of all of the coin-in/credit-in is applied to the development of the gaming environment 300, such as improvements to the infrastructure (e.g., construction of dams, bridges, airports, roads, railroads, etc.) from which individual players are unable to directly profit, growth of money trees (e.g., one tree for each $100, etc.), or any other visual representation providing an approximation of the value of the progressive. In another example, the value of the progressive could be represented by the land itself. The field of view of the gaming environment could, on the area display(s), continue to widen and widen as new land is added to the periphery of the gaming environment. The secondary display 16, 116 for each gaming machines would continue to show the players land, optionally in a scale/zoom selected by the player. At the end of the progressive event and following distribution or award of the progressive award, these alterations of the default gaming environment 300 would be removed.

In one embodiment, players may be required to purchase land as a buy-in to the game. Each plot of land could be presented in a tiered or ranked hierarchy of less desirable to more desirable in terms of size, location, etc., with correspondingly different "buy-in" values. Proportional to or in consideration of the different levels of "buy-in," the different levels of property would have associated therewith slightly different EV, volatility, odds or characteristics. In one aspect thereof, the slightly different EVs, volatility, odds or characteristics would be set to essentially equalize the overall EV or return from each of the properties. As mentioned above, an incoming player may be permitted to buy land that has been developed (or not) by other players, either from the controller (e.g., 34) or directly from an outgoing player. At the time of purchase, the player may be required to pony-up a significant amount of money if the property is heavily developed (e.g., significant assets associated with the property in the gaming environment 300).

In still other embodiments, players may be required to maintain a certain amount of coin-in/credit-in to hold onto the property. In one example, a certain piece of land in the gaming environment 300 may require a coin-in of $10/minute and player one, being a big better, has no problem maintaining this land. However, player's two and three desire a piece of land requiring a coin-in of $10/minute, but do not want to individually bear such wagers and hypothetically do not want a piece of land that might only require $2/min or $5/min, for example. Player two and player three are permitted to band together, so that their coin-in is aggrandized. As another example, if it only takes a dollar side bet to own a plot of land in the gaming environment, five players could each pay $0.20 or one player could pay $0.30 and another player could pay $0.70 (e.g., by pushing a $0.10 increment button a corresponding number of times or by selecting a button showing a desired input). Any payout from the land would be apportioned between player two and player three based upon each of player two's and player three's coin-in. Such apportionment may be calculated based upon the relative contributions of the single wager which led to the winning outcome or a historical or statistical analysis of the wagering of player two and player three. Thus, multiple players can share one space (e.g., land, etc.) in the gaming environment 300.

In embodiments of the present concepts which require a coin-in/credit-in requirement, various intermediary stages may occur prior to termination of a player's rights in property that is associated with the player. As a first measure, it is desirable to provide a coin-in/credit-in meter than provides a visual indication to the player as to their level of satisfaction of such requirement. The visual indication, such as a pie chart or a moving colored bar relative to one or more reference points, could start to flash or could become highlighted with a glowing halo. Another visual indication might include, but is not limited to, a visual indication on the player's land in the gaming environment 300 on the secondary display 16, 116 and/or area display(s), such as a glowing or flashing halo around the player's land. Alternatively, a halo could be provided about the player's land when the player is eligible and the halo could fade away and flash before it completely disappears. At the point at which the halo starts to flash or at the point at which the halo disappears, the player may be permitted a predetermined period of time, such as one minute, to insert a sufficient amount of coinage/credit to prevent loss of the player's land. Commensurate therewith, the player's assets may also provide a visual indication of the impending loss of land (e.g., workers start pulling down and packing up their tents, moving vans appear, cattle start to move out, the crops begin to wither, housing become dilapidated, etc.).

With respect to a bonus event such as a Big Event, each parcel of land owned, maintained, or funded by the player could serve as a bonus multiplier. For example, if the bonus event were a progressive, each parcel of land would represent one chance at the progressive. Thus, if it costs $10/min to maintain a property and player one inputs $100/min to maintain 10 properties, player one will have ten chances at the progressive and would have a statistically greater chance of winning the progressive over another player that maintains a single property.

To foster group involvement and camaraderie, the eligibility for the bonus event may be divided up so that individual player's are not eligible on their own. Instead, a plurality of players would be collectively linked together and stand together and fall together as a group. The linkage of a group of players may occur in any manner including, but not limited to, a voluntary selection of a group of players, proximity-based selection (e.g., a bank of gaming machines), or randomly selected. One of the players in a bank of gaming machines 10 could therefore trigger a bonus for all members of the group. Although the bonus prize would be divided up among the members of the group, the player that triggered the bonus for the group would receive good will from the other members of the group.

The triggering of and/or the award of a bonus event or bonus round may also be based, in at least some aspects, on satisfaction of a group requirement. For example, each member in a group of a players is provided (e.g., on the secondary display 16, 116) a bingo-type card or similar representation and each position in the card includes a reel symbol. The group may optionally be limited to a predefined number of players. In a competition (e.g., a timed competition) between groups, for example, each player in the group would seek to obtain a winning combination sufficient to knock off one of the symbols on the group's card or, alternatively, to fill in a symbol on the group's card. The group would, for example, get paid a bonus when the group's card had a straight line, or possibly any line straight or curved, of symbols or when all of the symbol positions have been filled/removed. As one example of this general concept, Group A and Group B are competing groups and each represent a bank of gaming machines 10. Group C is another competing group representing a bank of handheld gaming machines 110. Following triggering of a bonus event, each gaming machine 10, 110 is distributed a group card for the respective group and a competition ensure to see which of the groups is first able to achieve a card-related objective such as, but not limited to, filling in the card, filling in a line of the card, filling in a critical position of the card, etc. As each of the gaming machines 10, 110 in a group yields a winning outcome, symbol, or symbol combination that is represented on the card, the group's card is updated.

Continuing with the above example, certain winning outcomes may accelerate the competition. For example, a fairly unlikely outcome (e.g., 1 in a 1000) may be selected to automatically fill in a row on a group's card during a bonus event and an extremely unlikely outcome (e.g., 1 in a 10,000) may be selected to automatically fill in the group's entire card during a bonus event. In various persistent-state aspects, the group size may be maintained small enough (e.g., less than about 10-20 players) and the difficulty of filling the card great enough that it will, statistically speaking, taking a period of time (e.g., hours, days, weeks) to reasonably complete the card. Players in the group may enter and exit the game at will.

To account for disparities in the numbers of players in each of the groups in any of the above examples or embodiments, the controller (e.g., 34) can change the odds based on the number of people playing in each group to equalize the odds between the groups.

In other embodiments, a group persistent-state extends beyond local area networks which might be constrained to limited number of machines (e.g., 10, 20, 50, 100, etc.) out on the gaming establishment floor 10. As noted above, the gaming environment 300 is amendable to WANs supporting large groups. As each player in a group plays a gaming machine (e.g., 10, 110, etc.) associated with the gaming environment 300, their outcomes are modifying, and in most if not all instances enhancing, the group. So, as players play their own game, they are enhancing their group by at least some persistent-state metrics. The player's wins may not be divided among any other group members, but the wins are tabulated and accounted. In at least some aspects, those persistent-state metrics may be periodically (e.g., hourly, daily, weekly, monthly, quarterly, bi-annually, annually, etc. at all periods therebetween) tallied and ranked to determine which of the groups is eligible for a bonus or a bonus event. Preferably, such accounting statistically accommodates for differences in group sizes to yield an average or weighted per-player persistent-state metric (e.g., success rate).

Figure 6A:
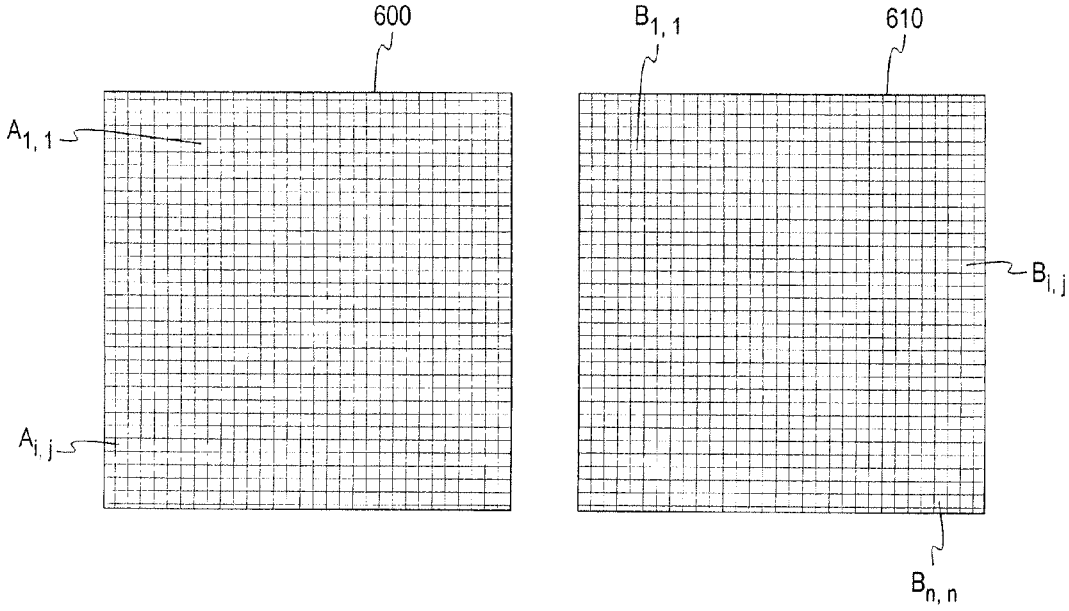
FIGS. 6(*a*)-(*c*) depicts another example of at least some aspects of the present concepts.
Figure 6B:
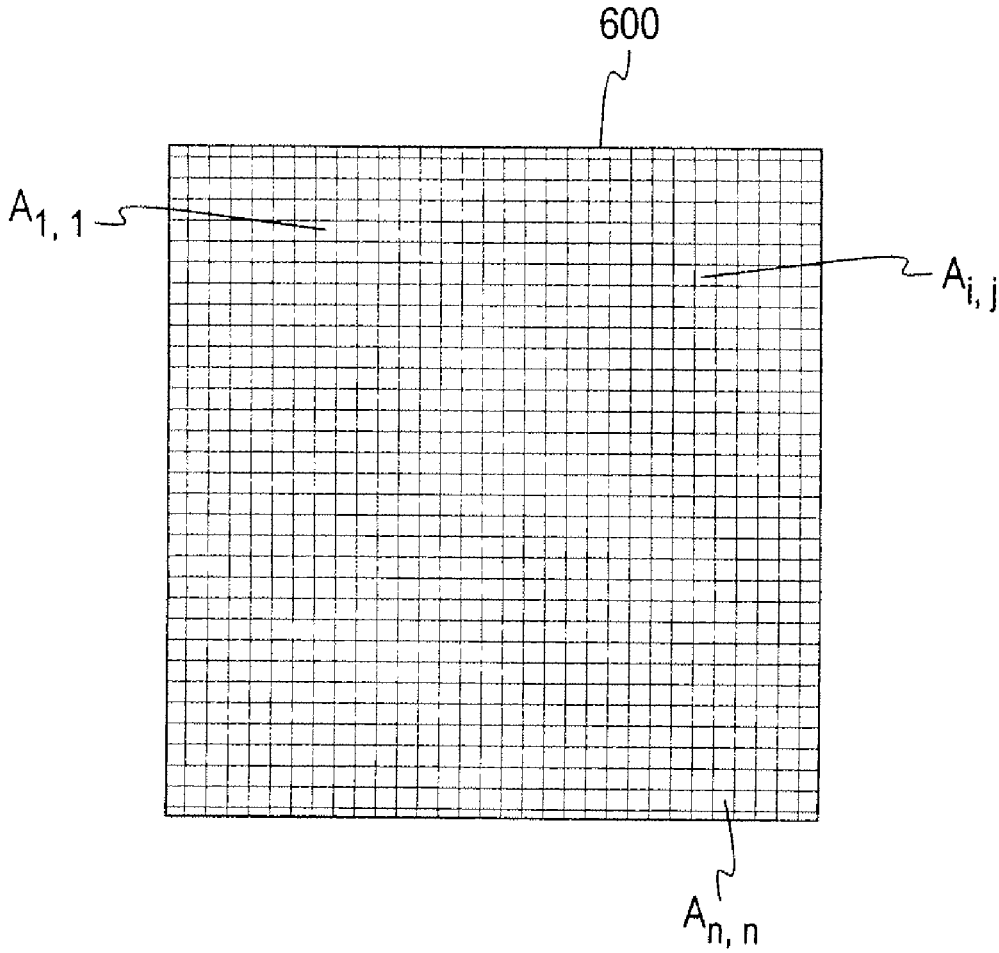
Figure 6C:
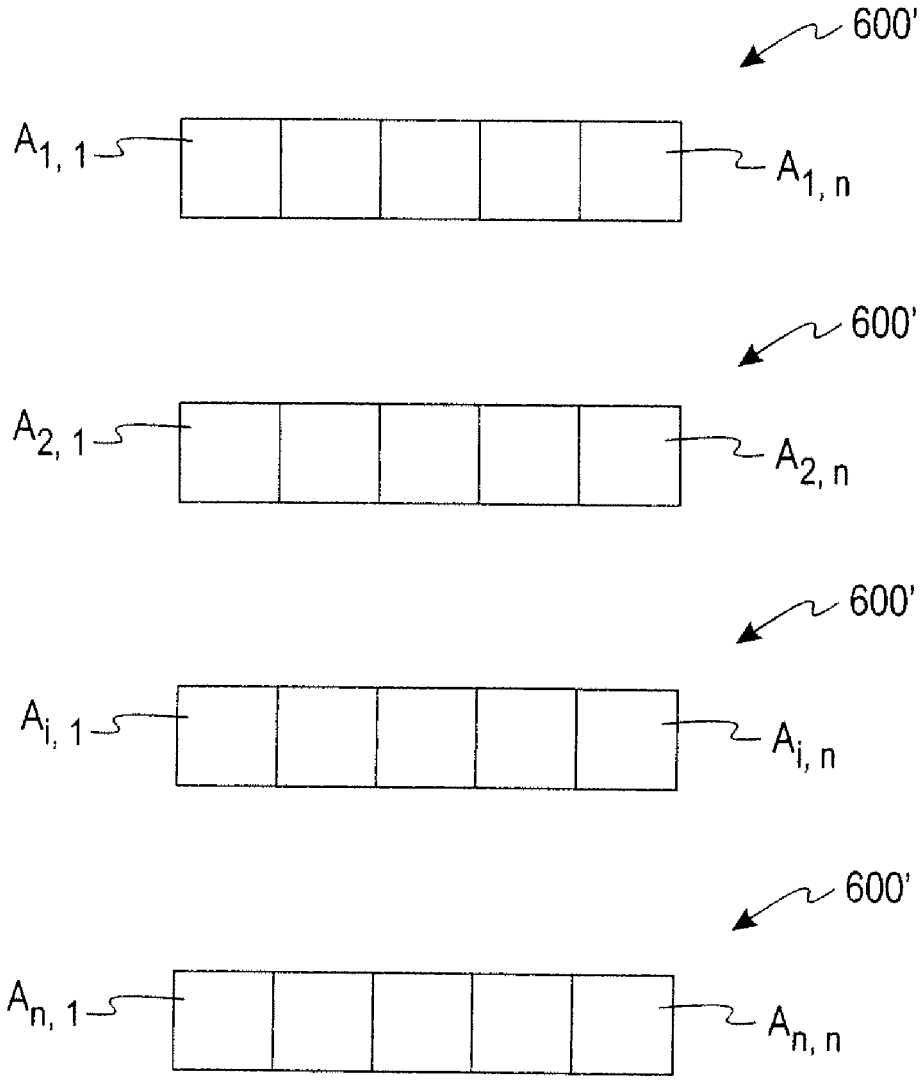

In still other embodiments, such as is represented in FIG. 6(*a*)-(*c*), a ladder concept of competition for an award may be provided wherein various groups 600, 610 are selected to participate in a competition. Group 600 comprises a plurality of players, represented simply as players $A_{i,j}$ in a matrix (e.g., $A_{1,1} \ldots A_{m,n}$ or $A_{1,1} \ldots A_{m,n}$, wherein i, j, m, and n represent integers) and group 610 comprises a plurality of players, represented simply as players $B_{i,j}$ in a matrix (e.g., $B_{1,1} \ldots B_{m,n}$ or $B_{1,1} \ldots B_{m,n}$). Each competition reduces the field of competition until, over time, one group (e.g., 600) is selected for continued play, as shown in FIG. 6(*b*), wherein group 610 has been eliminated. As shown in FIG. 6(*c*), the remaining group 600 has been divided into sub-groups 600' comprising, for example, groups of players $A_{1,1} \ldots A_{1,n}$, $A_{2,1} \ldots A_{2,n}$, $A_{i,1} \ldots A_{i,n}$, and $A_{n,1} \ldots A_{n,n}$. Each of the sub-groups 600' participate in one or more competitions to yield smaller and smaller subsets of the initial group 600 until one player or one sub-group is determined to be the winner of the award upon which the competition was based. Thus, the groups, sub-groups, and players all vie, over time, for an ultimate bonus prize, whatever its form (e.g., jackpot, progressive, Big Event, etc.). In one aspect, the ultimate bonus prize may be a tiered or nested progressive game having several tiers of progressive awards, such as a small group progressive award and a large individual or sub-group progressive award. For example, a predetermined number of clans, which can be any number (e.g., fifteen), are formed, each clan having a unique name, colors, insignia, and the like. Players in the various clans may log into and out of the gaming environment 300 at will.

Each of the clans compete against one another to achieve a goal to survive an initial elimination round, such as is described by way of example with regard to FIGS. 6(*a*)-(*c*). The goal could comprise any measure of team play including, but not limited to, an average per-player coin-in/credit-in, a success rate, or an achievement of one or more particular winning outcomes (e.g., triggering events). The elimination round could eliminate one or more of the groups. The remaining groups would continue to compete against each other in another elimination round and additional elimination rounds, as necessary, until a single group remains. In some aspects, the group itself would receive a group bonus (e.g., a small progressive award) divided amongst the group members. At this point, the group splinters into individuals or sub-groups, each competing for the large individual or sub-group progressive award, respectively. Such competition may be set up, for example, as a mystery progressive or even a multiple mystery progressive where satisfaction of a first mystery progressive automatically leads the players who satisfied the first mystery progressive into a second mystery progressive. So, at the point that a group splinters into sub-groups, players A and B (sub-group 1) and trying to satisfy the first mystery progressive before players C and D (sub-group 2) can do so. Each of the players A-D know that the first mystery progressive award will be triggered/awarded by the time it reaches $10,000 and they compete for this award. Once a sub-group wins the first mystery progressive award, the group is then again divided, now into player A vs. player B, who then vie for the large individual progressive award.

The scale of the aforementioned competition may be scaled up or down and one or more awards may be distributed at various milestones of wagering game play and the type of award and amount of the award(s) may be freely varied. In one example, there is only a single progressive award that is awarded to the surviving smallest denominator, whether such smallest denominator be a group, sub-group, or individual. In the example above, it is generally assumed that the players would need to be actively playing to advance to the next level of the tournament, although that is not necessarily a requirement. The competition itself may be for a progressive, an mystery jackpot between an upper and lower value, a disclosed jackpot, a Big Event or visual progressive, or any other type of bonus.

Moreover, persistent-state or saved-state games for group or tournament events permits time-based elongation of bonus games. For example, a group of randomly selected players are notified (e.g., via text messaging, e-mail, letter, voice mail, etc.) that they were randomly granted eligibility to win a progressive award, with the winner to be determined at some predetermined point in the future (e.g., in a week, in two weeks, etc.). The player is not necessary required to be present to win and the progressive award will be awarded to the player, of the selected players, who achieves, as compared to the other players, the highest level of a performance-based metric between the notification and the awarding of the progressive award or who first achieves a particular triggering outcome. In one case, the progressive is a mystery progressive wherein the trigger for the progressive is not immediately revealed. For example, one player, whose identity is known to the gaming establishment via the player's player ID card, plays the $10,000 mystery progressive game between $2,947 and $3,078 dollars and then stops playing and goes home. In this example, the mystery progressive award is not awarded until the turn over reaches $10,000. So, anyone who's participated can potentially win, provided their identity is known. Thus, a player may have won the mystery progressive three days ago, but not realized that he or she won since the winner isn't announced until the specified turn over point. Meanwhile, following such triggering event for the mystery progressive, the subsequent coin-in/credit-in is applied to a subsequent, as yet unrevealed mystery progressive, which will be revealed following the reveal of the former mystery progressive.

In yet another example of a persistent-state or saved-state game for a group having a time-elongated bonus game, a large group of players (e.g., 500, 1000, etc.) is notified that they were randomly selected to participate in a competition and they are informed progression to the next level of the competition if possible only if they achieve a specified combination of reel symbols along an active pay-line (e.g., a 4 symbol combination). In one aspect, the players are randomly selected from a pool of prior players, current players, and/or player's belonging to a player's club of the gaming establishment. For example, a player's prior game play comprises an entry into a drawing to compete for a larger prize, which competition may last for days or weeks. To equalize the odds between players and to minimize potential undue influence of players with large bankrolls, each of the players in the group may optionally be provided a predetermined number of spins (e.g., 100 spins) or coin-in/credit-in and the player having the best personal outcome over the predetermined number of spins or coin-in/credit-in wins the prize. In the event of a tie, the remaining players could repeat the process. In another variant, the biggest loser would win the large prize and the players who won amounts in the 100 spins would keep whatever awards were accumulated. Play would continue until the biggest loser finally wins the large prize. In still another variant, the tournament could be both time-based and outcome-based and the players are all notified of such constraints. Thus, the players all rush to be the first to achieve the specified outcome as quickly as possible. To prevent untoward incidents, the size of the group could correspond to the number of available gaming machines and the use of the gaming machines could be specially reserved for the start of the tournament.

In another embodiment, as noted above, a player registers with or joins a group (e.g., "left handed slot players USA," etc.). Each hour, day, week, or month, a randomly selected member of the group is selected to satisfy a triggering event. The other group members are optionally notified of the player's selection. If that player is able to satisfy the triggering event, all of the group members are then eligible for some bonus condition, enhancement, game modifier, eligibility, award, game and/or event. So if the selected player in the group satisfies a triggering event such that every subsequent spin is a lucky draw eligible entry, this benefit is conveyed to other members of the group for a predetermined period of time.

One common theme in many of these examples is the persistency of community. The co-mingling of ones personal success and achievements, as well as losses, with those of other members of the group, and the persistency of the groups, provide a sense of community and, at times, status within the community. Membership in such groups may be exclusive or non-exclusive.

In any of the above concepts, groups may define themselves in many ways and such definition may optionally carry through into the gaming environment 300 and/or the gaming experience on the gaming machines 10, 110. The theme of the game played by the players could even be heavily influenced by the definition of the group. In other words, if the group has selected an ancient Greece theme, the group members may enjoy an ancient Greece bonus round, whereas players of another group may enjoy different types of bonus rounds, regardless of the actual base game. If a player in such a group received an expanding wilds, the expanding wilds variant has an ancient Greece theme.

In accord with any of the above concepts, various options and choices may be presented to a group. In at least some aspects, a ranking player (e.g., highest grossing player, highest amount of coin-in/credit-in, elections, etc.) is permitted to make decisions for the group. In at least some other aspects, decisions presented to the group may be decided by general consensus, majority vote, super-majority vote, or the like. As one example, a group may be presented with an opportunity to attempt to obtain either a low probability, high value jackpot or a higher probability, lower value jackpot. The group has to decide, in some manner, which jackpot to pursue.

While the presently disclosed concepts have been described with reference to one or more particular embodiments, those skilled in the art will recognize that many changes may be made thereto without departing from the spirit and scope of the presently disclosed concepts. For example, each of the acts disclosed herein, in isolation or in any combination, is amenable to coding in an instruction set on a computer-readable medium for execution on a computer.

Each of these embodiments and obvious variations thereof is contemplated as falling within the spirit and scope of the concepts which are set forth in the following claims. For example, although the gaming environment 300 and player's selected sub-portion 310 have generally been discussed using land as a physical example, neither the gaming environment nor the player's selected sub-portion 310 are limited to such example. The player's selected sub-portion 310 could comprise any object or commodity. For example, the player's selected sub-portion 310 could be a virtual slot machine that automatically plays and is modified based on game outcomes, player inputs, player purchases, add-ons or external variables, such as noted above. In another example, the player's selected sub-portion 310 could comprise a virtual person (e.g., a super-hero, a person of a selected profession, etc.) and the virtual person's abilities, attributes, and/or status within the gaming environment 300 would be modified on game outcomes, player inputs, player purchases, add-ons or external variables, such as noted above. Thus, for example, the gaming environment 300 may be directed to a city, state, country or world wherein the player's virtual person(s) (e.g., superheros, villains, celebrities, normal people) interact with one-another and/or the gaming environment.

What is claimed is:

1. A gaming system for playing a wagering game, comprising:

a plurality of gaming machines configured to receive a wagering input, to conduct the wagering game, and to access a group game comprising a persistent-state gaming environment responsive to a triggering event; and a controller configured to maintain said persistent-state gaming environment and to control game play within said persistent-state gaming environment, wherein said persistent-state gaming environment is divided into a plurality of selectable sub-portions, wherein each of the plurality of gaming machines participating in the group game is uniquely associated with one or more of said selectable sub-portions of the persistent-state gaming environment;

wherein an asset generated by an identified one of the plurality of gaming machines in association with the wagering game is transferred into the one or more of said selectable sub-portions of the persistent-state gaming environment uniquely associated with the identified one of the plurality of gaming machines, wherein said asset is redeemable only by the identified one of the plurality of gaming machines causing the asset to be transferred into the persistent-state gaming environment or by a player associated with the identified one of the plurality of gaming machines causing the asset to be transferred into the persistent-state gaming environment, and wherein a value of said asset is modifiable in the persistent-state gaming environment prior to redemption.

2. The gaming system of claim 1, wherein said controller is configured to permit player-selection of an available one of said plurality of selectable sub-portions.

3. The gaming system of claim 2, further comprising:

a random number generator configured to generate a random outcome associated with said persistent-state gaming environment and to associate said random outcome with a positive asset modification or a negative asset modification, wherein said controller is configured to associate said random outcome with said selected sub-portion in said persistent-state gaming environment and to respectively increase or decrease said modifiable asset responsive to said random outcome.

4. The gaming system of claim 1, wherein said controller is configured to, responsive to a winning outcome in the wagering game conducted on the gaming machine, update said modifiable asset in said selected sub-portion in said persistent-state gaming environment commensurate with said winning outcome.

5. The gaming system of claim 1, wherein said persistent-state gaming environment comprises an economy within which players are permitted to sell a gaming environment asset to another player, barter a gaming environment asset with another player, exchange a gaming environment asset with another player, auction a gaming environment asset to another player, or purchase a gaming environment asset from another player.

6. A method of conducting a wagering game in connection with a persistent-state gaming environment, comprising the acts of:

operating a group game comprising a persistent-state gaming environment at a plurality of wagering game machines;

creating a modifiable asset in said persistent-state gaming environment in association with a player, the act of creating the player's modifiable asset further comprising storing the player's modifiable asset in a memory device associated with said persistent-state gaming environment and storing the player's modifiable asset in the persistent-state gaming environment until the player's modifiable asset is selectively redeemed by the player;

modifying the player's modifiable asset in the persistent-state gaming environment responsive to a winning outcome in game conducted by the player in association with the persistent-state gaming environment; and redeeming said modifiable asset, responsive to a redemption instruction input by the player, in the form of at least one of currency or credit.

7. The method of claim 6, further comprising the act of dividing the persistent-state gaming environment into a plurality of sub-portions, wherein the player's modifiable asset is associated with a selected sub-portion.

8. The method of claim 7, further comprising modifying the player's modifiable asset in the persistent-state gaming environment responsive to a random event in the persistent-state gaming environment, wherein the act of modifying the player's modifiable asset in the persistent-state gaming environment responsive to the random event in the persistent-state gaming environment comprises increasing or decreasing a value of the modifiable asset.

9. The method of claim 7, further comprising establishing an economy within said persistent-state gaming environment to permit a player to, at any time, sell the player's modifiable asset to another player or to exchange the player's modifiable asset with another player for another modifiable asset, cash, or credits.

10. A method of conducting a wagering game in connection with a persistent-state gaming environment, comprising the acts of:

linking a plurality of wagering game machines in a network to participate in a persistent-state gaming environment group game, the persistent-state gaming environment group game being controlled by a controller;

using the controller, assigning each of said plurality of wagering game machines in said group game to one of a plurality of sub-groups;

initiating, in said group game, a competition between said plurality of sub-groups to determine which of the plurality of sub-groups is eligible for an award;

continuing said competition until an occurrence of a lapse of a predetermined period of time or an occurrence of a triggering event;

determining, using the controller, a winning sub-group of said competition; and awarding said award or awards relating thereto to said winning sub-group, wherein a winning outcome or other predetermined outcome during wagering game play on a wagering game machine in said competition during said competition allocates a deployable asset in said competition in association with a wagering game machine's sub-group, and wherein the deployable asset enhances a position of the sub-group in the competition.

11. A method of conducting a wagering game in connection with a persistent-state gaming environment, comprising the acts of:

providing a plurality of gaming machines configured to access a network group game associated with a wagering game, the network group game comprising a persistent-state gaming environment, the persistent-state gaming environment being divided into a plurality of selectable sub-portions;

associating a plurality of players of said wagering game machines as a group responsive to inputs from said plurality of players to form said group, each of the plurality of players being uniquely associated with one or more of said selectable sub-portions of the persistent-state gaming environment;

conducting the network group game for said plurality of players associated as said group;

transferring one or more assets generated by an identified one of the plurality of players in association with the network game into the one or more of said selectable sub-portions of the persistent-state gaming environment uniquely associated with the identified player, the asset being modifiable in the persistent-state gaming environment prior to redemption;

saving in a memory, responsive to an input by said group, a state of play of said group in said network group game.

12. The method of claim 11, further comprising, subsequent to said step of saving in a memory a state of the group play of said network group game, terminating play of said group play of said network group game.

13. The method of claim 12, further comprising, subsequent to said step of terminating play of said group play of said network group game, the act of reinstating from said memory a state of the group play of said network group game for said group or reinstating from said memory a state of the group play of said network group game for a subgroup of said group.

14. The method of claim 11, further comprising, dividing the persistent-state gaming environment being into a plurality of selectable sub-portions;

uniquely associating each of the plurality of players with one or more of said selectable sub-portions of the persistent-state gaming environment; and transferring one or more assets generated by an identified one of the plurality of players in association with the network game is transferred into the one or more of said selectable sub-portions of the persistent-state gaming environment uniquely associated with the identified player, the asset being modifiable in the persistent-state gaming environment prior to redemption.

15. A method of conducting a wagering game in connection with a persistent-state gaming environment, comprising the acts of:

using a controller and a non-transitory memory device, maintaining a persistent-state gaming environment in association with the wagering game conducted on a plurality of wagering game machines;

conducting wagering games on the plurality of wagering game machines;

responsive to a first triggering event at a first wagering game machine of the plurality of wagering game machines, transferring a first group game asset into the persistent-state gaming environment and assigning the first group game asset to the first wagering game machine;

permitting modification of the first group game asset while the first group game asset is maintained in the persistent-state gaming environment; and redeeming the first group game asset by the first wagering game machine responsive to an instruction received from a player input device of the first wagering game machine, wherein said first group game asset is redeemable only by the assigned first wagering game machine causing the first group game asset to be transferred into the persistent-state gaming environment or by a player associated with the assigned first wagering game machine causing the first group game asset to be transferred into the persistent-state gaming environment.

16. The method of conducting a wagering game in connection with a persistent-state gaming environment according to claim 15, responsive to a second triggering event at a second wagering game machine of the plurality of wagering game machines, transferring a second group game asset into the persistent-state gaming environment and assigning the second group game asset to the second wagering game machine;

permitting modification of the second group game asset while the second group game asset is maintained in the persistent-state gaming environment; and redeeming the second group game asset by the second wagering game machine responsive to an instruction received from a player input device of the second wagering game machine.

17. The method of conducting a wagering game in connection with a persistent-state gaming environment according to claim 16, wherein the first group game asset is diminished, while the first group game asset is maintained in the persistent-state gaming environment, responsive to third triggering event at the first wagering game machine.

18. The method of conducting a wagering game in connection with a persistent-state gaming environment according to claim 17, wherein the first group game asset is decreased, while the first group game asset is maintained in the persistent-state gaming environment, responsive to a random event occurring in the persistent-state gaming environment.

19. The method of conducting a wagering game in connection with a persistent-state gaming environment according to claim 18, wherein the random event occurring in the persistent-state gaming environment is triggered by a third triggering event at the first wagering game machine.

20. The method of conducting a wagering game in connection with a persistent-state gaming environment according to claim 19, wherein the random event occurring in the persistent-state gaming environment is triggered by a fourth triggering event at another wagering game machine.

21. The method of conducting a wagering game in connection with a persistent-state gaming environment according to claim 20, wherein the first group game asset is increased, while the first group game asset is maintained in the persistent-state gaming environment, responsive to a fifth triggering event at the first wagering game machine.

22. The method of conducting a wagering game in connection with a persistent-state gaming environment according to claim 21, wherein the random event occurring in the persistent-state gaming environment is triggered by a sixth triggering event at the first wagering game machine.

23. The method of conducting a wagering game in connection with a persistent-state gaming environment according to claim 22, wherein the random event occurring in the persistent-state gaming environment is triggered by a seventh triggering event at another wagering game machine.

24. The method of conducting a wagering game in connection with a persistent-state gaming environment according to claim 15, wherein the instruction received from the player input device of the first wagering game machine is an instruction specific to redemption.

25. The method of conducting a wagering game in connection with a persistent-state gaming environment according to claim 15, wherein the first group game asset is increased, while the first group game asset is maintained in the persistent-state gaming environment, responsive to a random event occurring in the persistent-state gaming environment.

* * * * *

UNITED STATES PATENT AND TRADEMARK OFFICE

CERTIFICATE OF CORRECTION

PATENT NO. : 8,371,919 B2
APPLICATION NO. : 12/446141
DATED : February 12, 2013
INVENTOR(S) : Hornik et al.

It is certified that error appears in the above-identified patent and that said Letters Patent is hereby corrected as shown below:

In the Claims:

In column 28, line 66 (claim 6), after "in" please insert -- a --.

Signed and Sealed this
Twenty-third Day of July, 2013

Teresa Stanek Rea
*Acting Director of the United States Patent and Trademark Office*